US012808169B2

(12) United States Patent
Rosario

(10) Patent No.: US 12,808,169 B2
(45) Date of Patent: Nov. 24, 2026

(54) POPUP DRAIN STOPPER WITH DEBRIS TRAP AND POPUP DRAIN STOPPER ASSEMBLY HAVING THE SAME

(71) Applicant: Israel Rosario, Davie, FL (US)

(72) Inventor: Israel Rosario, Davie, FL (US)

( * ) Notice: Subject to any disclaimer, the term of this patent is extended or adjusted under 35 U.S.C. 154(b) by 510 days.

(21) Appl. No.: 17/981,515

(22) Filed: Nov. 7, 2022

(65) Prior Publication Data

US 2023/0125638 A1 Apr. 27, 2023

Related U.S. Application Data

(63) Continuation-in-part of application No. 17/564,284, filed on Dec. 29, 2021, now Pat. No. 11,608,620, which is a continuation-in-part of application No. 17/408,556, filed on Aug. 23, 2021, now Pat. No. 11,421,408.

(60) Provisional application No. 63/258,068, filed on Apr. 12, 2021.

(51) Int. Cl.
*E03C 1/262* (2006.01)
*E03C 1/23* (2006.01)

(52) U.S. Cl.
CPC ..... *E03C 1/262* (2013.01); *E03C 1/2302* (2013.01)

(58) Field of Classification Search
CPC ..... E03C 1/262; E03C 1/26; E03C 1/264
See application file for complete search history.

(56) References Cited

U.S. PATENT DOCUMENTS

| | | | | |
|---|---|---|---|---|
| 3,453,667 | A * | 7/1969 | Politz | E03C 1/23 4/295 |
| 9,499,962 | B2 * | 11/2016 | Joseph | E03C 1/262 |
| 9,611,631 | B2 * | 4/2017 | Rosko | E03C 1/2302 |
| 9,752,306 | B2 * | 9/2017 | Scamuffa | E03C 1/264 |
| 2011/0126347 | A1 * | 6/2011 | Qian | E03C 1/2302 4/287 |
| 2017/0314245 | A1 * | 11/2017 | Beck | E03C 1/2306 |

* cited by examiner

*Primary Examiner* — Janie M Loeppke
(74) *Attorney, Agent, or Firm* — Lewellyn Law, PLLC; Stephen Lewellyn

(57) ABSTRACT

The present disclosure relates to popup drain stopper and popup drain stopper assemblies. The popup drain stopper includes a debris trap having a plurality of bristle arranged to trap debris flowing into a drainpipe in which the stopper is positioned. Popup drain stopper assemblies include the popup drain stopper with the debris trap and the ability to remove the drain stopper from the drainpipe without disassembly. The stopper includes a cylindrical shaped bristle body having the bristles and which is removable from the stopper assembly.

15 Claims, 19 Drawing Sheets

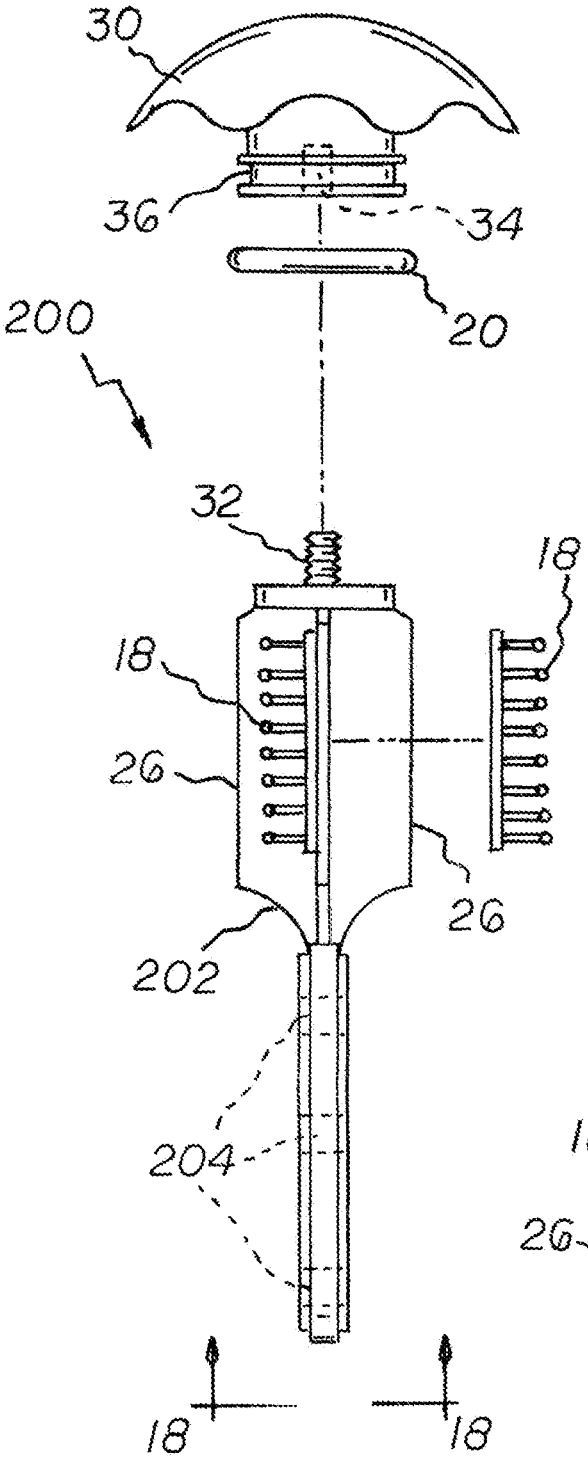
FIG. 17
FIG. 16
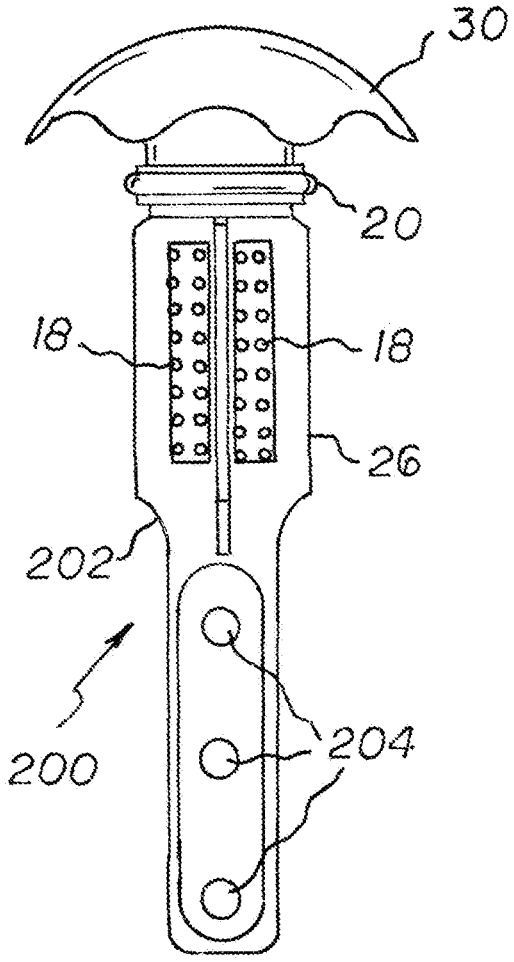
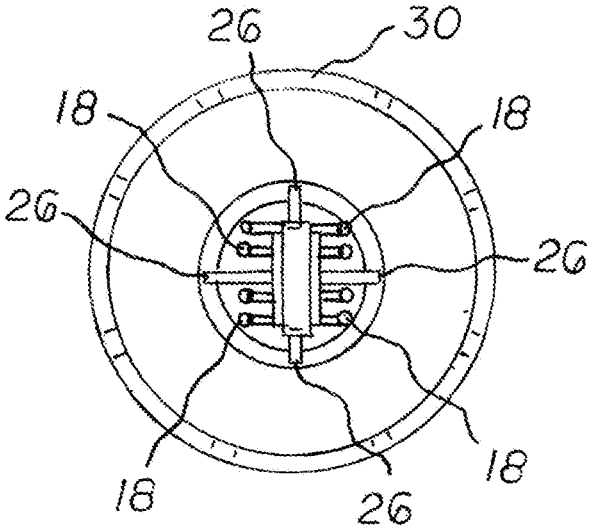
FIG. 18

POPUP DRAIN STOPPER WITH DEBRIS TRAP AND POPUP DRAIN STOPPER ASSEMBLY HAVING THE SAME

CROSS-REFERENCE TO RELATED APPLICATIONS

This application is a continuation-part of U.S. patent application Ser. No. 17/564,284, filed Dec. 29, 2022, which is a continuation-part of U.S. patent application Ser. No. 17/408,556, filed Aug. 23, 2021, which claims priority to U.S. Provisional Application 63/258,068, filed Apr. 12, 2021, and which are hereby incorporated herein by reference in their entirety.

FIELD OF THE INVENTION

The present disclosure relates to popup drain stoppers and, more particularly, to popup drain stoppers with debris traps and popup drain stopper assemblies having the same.

BACKGROUND OF THE INVENTION

Sinks, showers, and bathtubs contain a drainage outlet to permit the egress of water from the reservoir. The drainage outlet may be open or contain a drain protector to act as a sieve by removing debris from the flow of water before its entrance into the drain. Some drainage outlets are equipped with a pop-up plug allowing the user to selectively retain water in the reservoir before drainage.

Even with the use of a drain cover, drainpipes often become clogged due to the buildup of debris washed away by the flow of water. The leading cause of clogging is the accumulation of hair which slowly builds over time until the water no longer drains effectively. The inability of water to drain may result in unsanitary conditions and provides a medium for harboring bacteria and waterborne pathogens.

It can be undesirable to chemical-based drain cleaners due to their toxicity. The most common chemical is highly concentrated sulfuric acid which can dissolve cellulose, proteins, and fats. Such harsh chemicals are potentially dangerous if used improperly, and repeated use often results in damage to the drainpipes, leading to expensive repairs. Further, the chemicals found in drain cleaners may react with household products and cause explosive, or highly toxic reactants.

SUMMARY OF THE INVENTION

Embodiments described herein provide for a drain stopper and drain stopper assembly with a removable debris trap to prevent debris in wastewater from entering a drainpipe without the use of chemicals.

Embodiments described herein provide for a drain stopper assembly having a drain stopper with a debris trap and that is removably connectable to a lever rod of a drain stopper operating mechanism without requiring disassembly of the drain stopper operating mechanism.

Embodiments described herein provide for a drain stopper assembly having a drain stopper with a debris trap and that is selectively positionable and held in position in a drainpipe through magnetic coupling.

Embodiments described herein provide for a debris trap having various debris catching bristle configurations.

In one aspect, a popup drain stopper comprising has a stem configured to be movable vertically within a drainpipe. The stem has a top end, a bottom end, a length extending therebetween, and at least two fins extending along the length. A cap attached to the top end of the stem. And a plurality of bristles are attached to and extending outwardly from at least one fin and are configured to trap debris entering the drainpipe when the stem is disposed in the drainpipe.

In another aspect, a lower length of the stem is bifurcated into a pair of coextending tangs that are separated by a slot that extends from the bottom end of the stem in a direction toward the upper end of the stem. The slot is configured to removably receive a lever rod in a sliding engagement between the tangs in a direction upwardly from the bottom end of the stem. A lower end of each tang has a winglet that extends in opposite directions of one another and provide a fishtail-shaped notch therebetween at the bottom end of the stem. The fish-shaped notch narrows in a direction from the bottom end of the stopper toward the top end of the stopper. The winglets combined with the fishtail-shaped notch guide the lever rod toward the open end of the slot when the lever rod is slid into engagement with the slot.

In another aspect, a popup drain stopper assembly has a stem configured to be movable vertically within a drainpipe. The stem has a top end, a bottom end, a length extending therebetween, and at least two fins extending along the length. A cap is attached to the top end of the stem. A plurality of bristles are attached to and extending outwardly from at least one fin and are configured to trap debris entering the drainpipe when the stem is disposed in the drainpipe. A lower end of the stem has a plurality of stem magnets spaced along a length of the lower end. A retaining magnet is attached to the drainpipe and configured to selectivity retain the stem at a desired position in the drainpipe by a magnetic force between one of the stem magnets and the retaining magnet.

In another aspect, a popup drain stopper assembly has a stem configured to be movable vertically within a drainpipe. The stem has a top end, a bottom end, a length extending therebetween, and at least two fins extending along the length. A cap is attached to the top end of the stem. A plurality of bristles are attached to and extending outwardly from at least one fin and are configured to trap debris entering the drainpipe when the stem is disposed in the drainpipe. A stem magnet is attached to the bottom end of the stem. A lever rod extends into the drainpipe and has an engagement end. A retaining magnet is attached to the engagement end of the lever rod and configured to magnetically and removably couple with the stem magnet to connect the stem to the lever rod.

Numerous additional objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature or a feature with similar functionality. In the drawings:

FIG. 16 is a second side elevation view of the popup drain stopper of FIG. 15;

FIG. 17 is a second side elevation view of the popup drain stopper of FIG. 15, shown partially exploded;

FIG. 18 is a bottom view of the popup drain stopper of FIG. 15;

DETAILED DESCRIPTION

Embodiments of the invention provide a popup drain stopper with debris trap and popup drain assemblies having the same. As used herein, the term "debris" may refer to any object that may be transferred into a drain outlet and the drainpipe. By way of non-limiting example, the debris may include hair, hairpins, soaps and detergents, dust, dirt, cosmetic products, jewelry, or other small particles and objects.

Embodiments relate to a drain stopper configured to be at least partially inserted into a drain outlet. The drain stopper may be configured to be used in any plumbing fixture having a drain outlet including, but not limited to a floor drain, sink, bathtub, shower, lavatory, or similar drains wherein debris may cause a clog resulting in the inability to drain fluids. The drain stopper is comprised of a removable debris trap configured to filter and trap debris from obstructing the flow of water before the debris continues further into the drainpipe.

Figure 1:
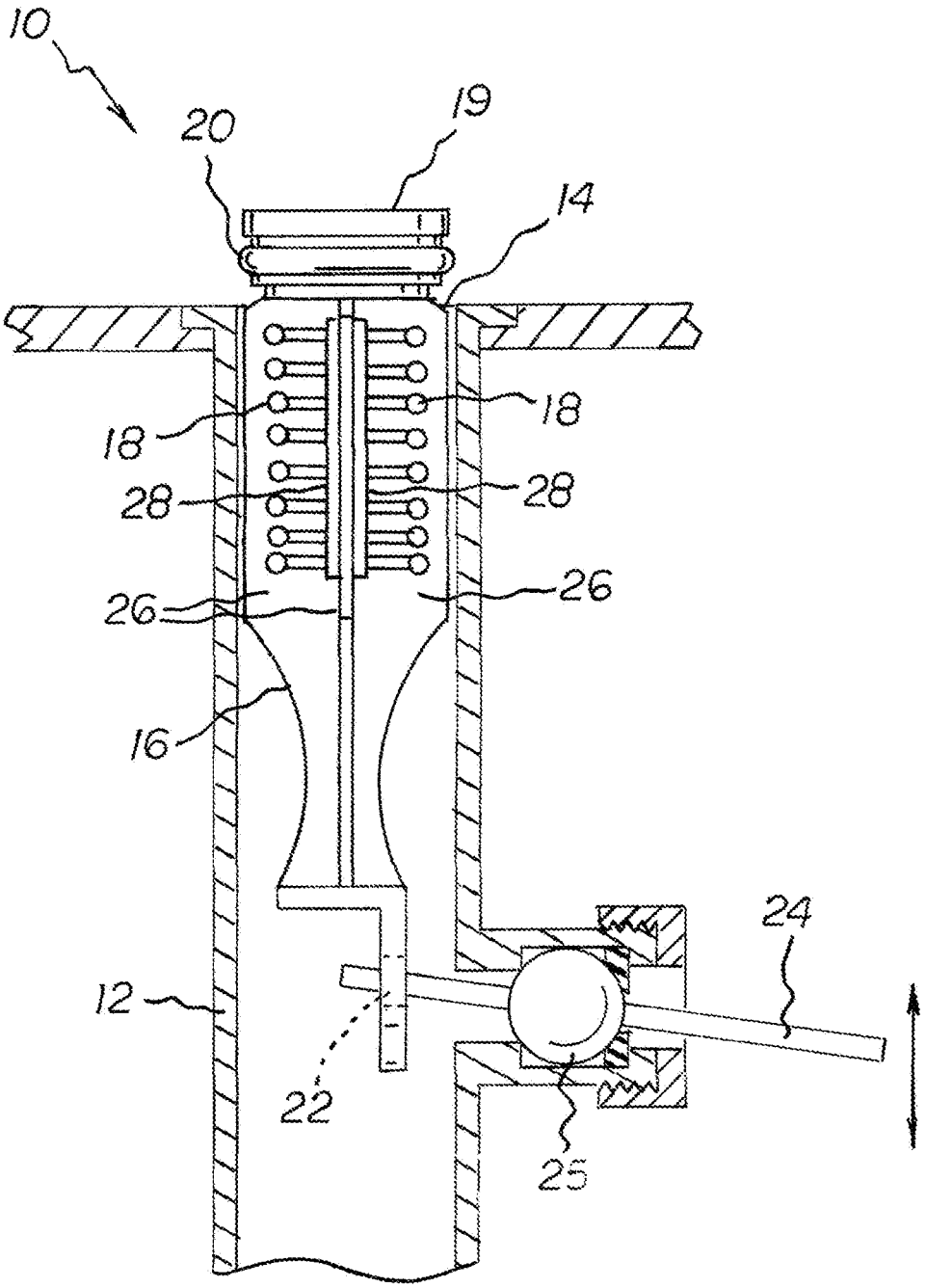
FIG. 1 is a first side elevation view, partially in cross-section, showing a popup drain stopper provided in accordance with an embodiment of the invention in a drainpipe.

In FIG. 1, there is illustrated a popup drain stopper 10 in accordance with an embodiment of the invention. The stopper 10 is shown disposed in the interior of a conventional drainpipe 12 having a drain opening 14 through which the stopper is inserted for up and down movement within the interior of the drainpipe to selectively seal the drain opening.

The stopper 10 has an elongated stem 16 with opposite, upper and lower ends. A cap 19 is attached to the stem at its upper end. The cap 19 has a seal, such as, for example an O-ring 20. The cap 19 and seal 20 extend above the drain opening 14 when raised to an elevated position and closes and seals the drain opening when lowered into a sealing position by the seal making a sealing contact with the drainpipe. In the representatively illustrated embodiment, the lower end of the stem 16 has an aperture 22 which engages with a lever rod 24 of a conventional stopper actuating mechanism that is well known in the art and operates raise and lower the stopper for sealing and opening the draining opening 14. The lever rod 24 is connected to a captive ball 25, which allows the rod to be pivoted upward and downward to move the stopper.

Figure 2:
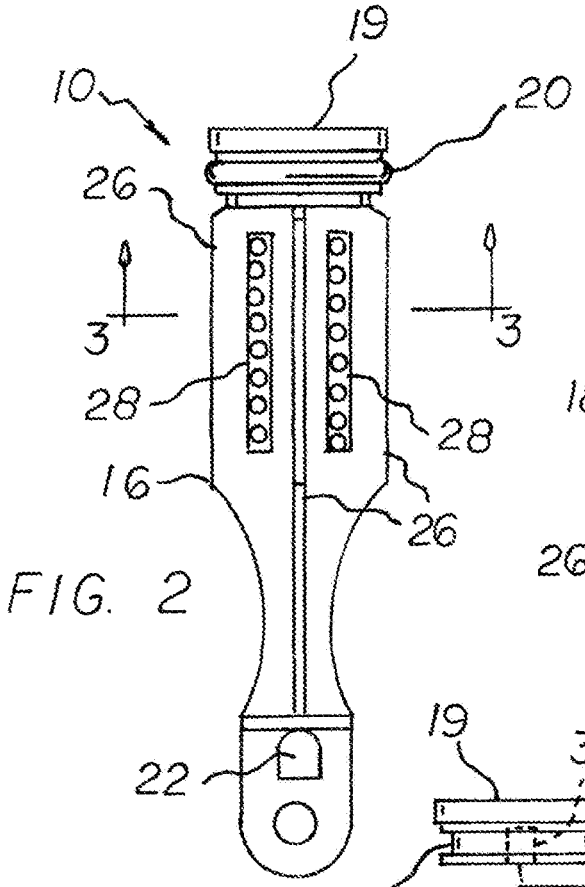
FIG. 2 is a second side elevation view of the popup drain stopper of FIG. 1.
Figure 3:
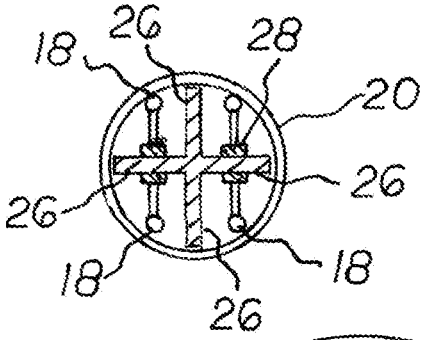
FIG. 3 is a bottom view of the popup drain stopper of FIG. 1.

With continued reference to FIG. 1 and further reference to FIGS. 2 and 3, the stem 16 has four, elongated, perpendicular ribs or fins 26 that extend along the length of the stem between its opposite ends. A row of bristles 28 is disposed along opposite broad surfaces of at least two fins 26 (one only visible in this figure) and extend outwardly therefrom in a direction that is generally perpendicular to the longitudinal length of the stem.

The bristles 28 provide a debris trap for trapping, collecting, or otherwise entangling debris that flows through the drain opening 14 and along the stopper 10. The debris being trapped by the bristles 28 is prevented from flowing through the drainpipe, thereby preventing clogging thereof. The stopper 10 can be removed from the drainpipe for clearing or cleaning the bristles of the debris.

While, in this representative embodiment, only a single row of bristles 28 is shown disposed on opposite surfaces of at least two fins 26, it should be understood the invention is not limited to this arrangement. Any number of rows, shape, size, or configuration of bristles may be disposed on the fins 26 for trapping, collecting, or otherwise entangling debris that flows through the drain opening could be used.

Figure 4:
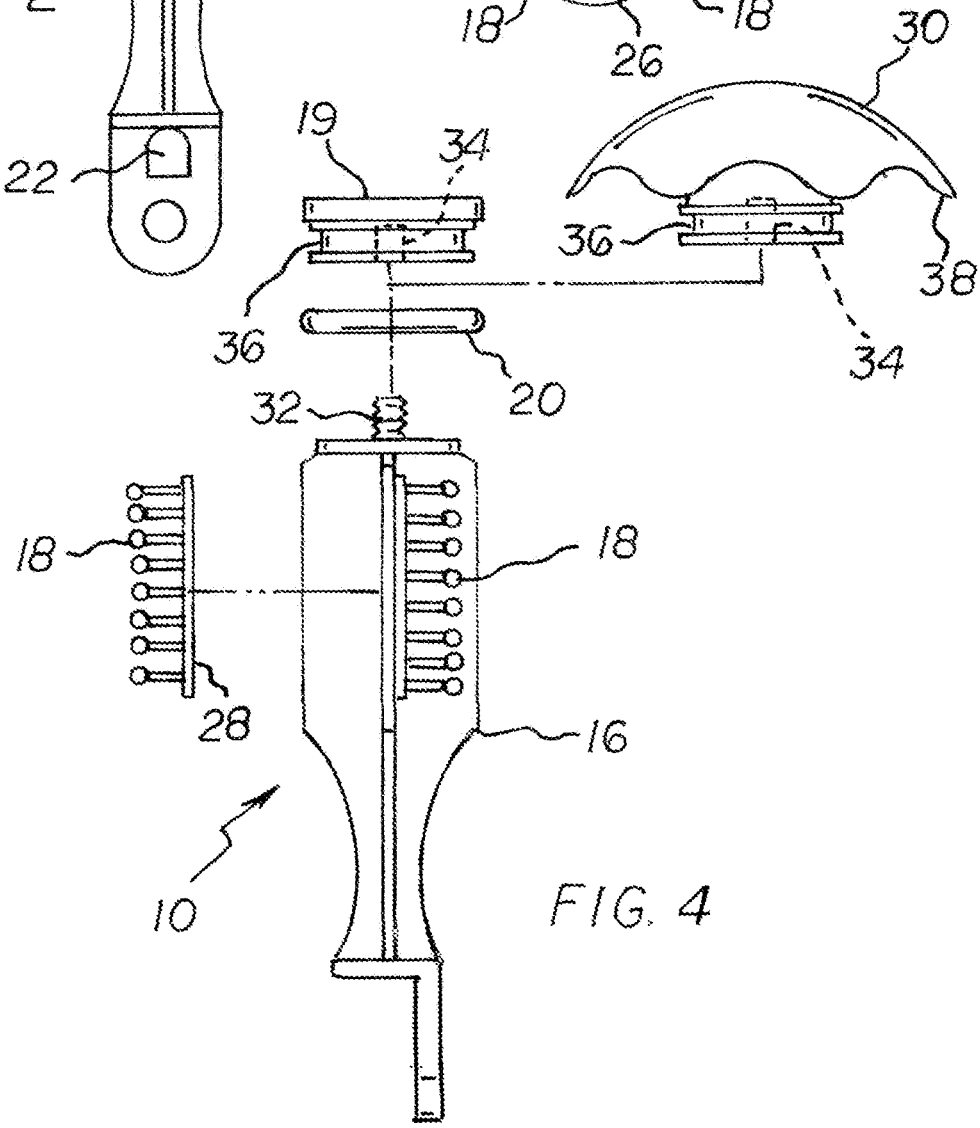
FIG. 4 is a side elevation view, partially exploded, of the popup drain stopper of FIG. 1.

With additional reference to FIG. 4, there is shown an exploded view of stopper 10. The upper end of the stem 16 may have a threaded stud 32 and the lower end of cap 19 may have a corresponding threaded aperture 34 to threadedly attach the cap to the upper end of the stem. The cap 19 may further include a circumferential groove 36 for receiving and retaining the seal 20. As further shown, the upper end of the cap 19 has a generally flat, cylindrical shape.

Figure 5:
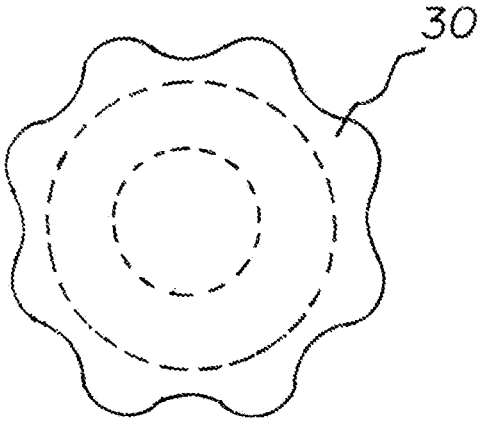
FIG. 5 is a top view of a cap provided in accordance with an embodiment of the invention.

Further shown is an alternative cap 30. Like cap 19, cap 30 includes a threaded aperture 34 for attaching the cap to the threaded stud 32 and includes a circumferential groove 36 for receiving and retaining the seal 20. The upper end of cap 30, however, is dome-shaped and includes a scallop-shaped circumferential edge 38. FIG. 5 illustrates at top-down view of cap 30.

Figure 6:
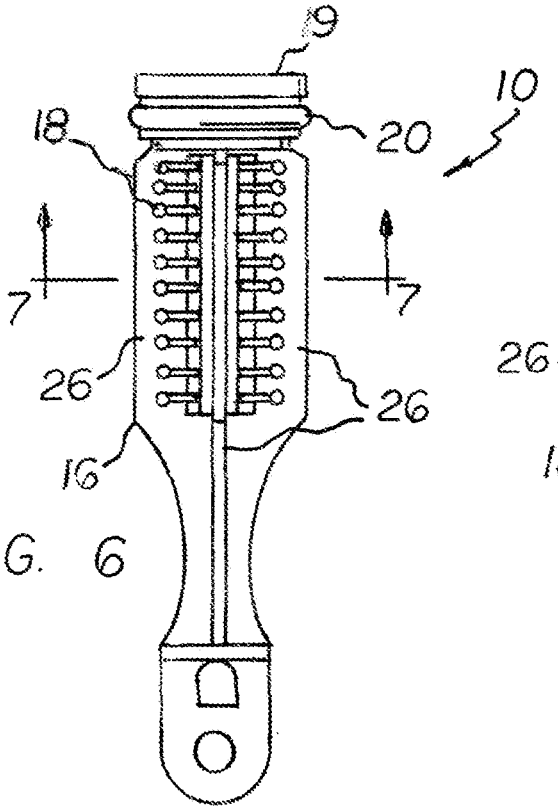
FIG. 6 is a side elevation view of popup drain stopper provided in accordance with an embodiment of the invention.
Figure 7:
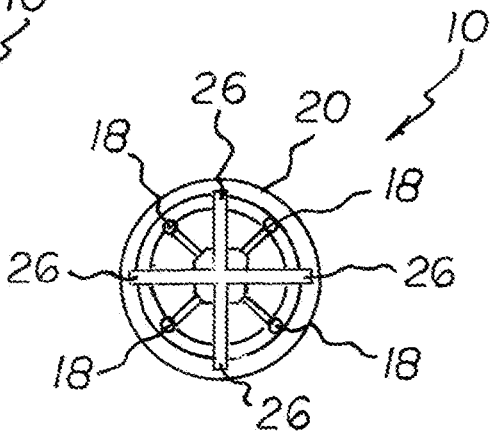
FIG. 7 is a bottom view of the popup drain stopper of FIG. 6.

In FIGS. 6 and 7, stopper 10 is shown with an alternative arrangement of bristles 28 on stem 16. Particularly, bristle rows 28 are disposed in the corners formed between two conjoining fins 26 and extend along the length of the fins and outwardly therefrom at generally 45 degrees relative to the corresponding fins.

Figure 8:
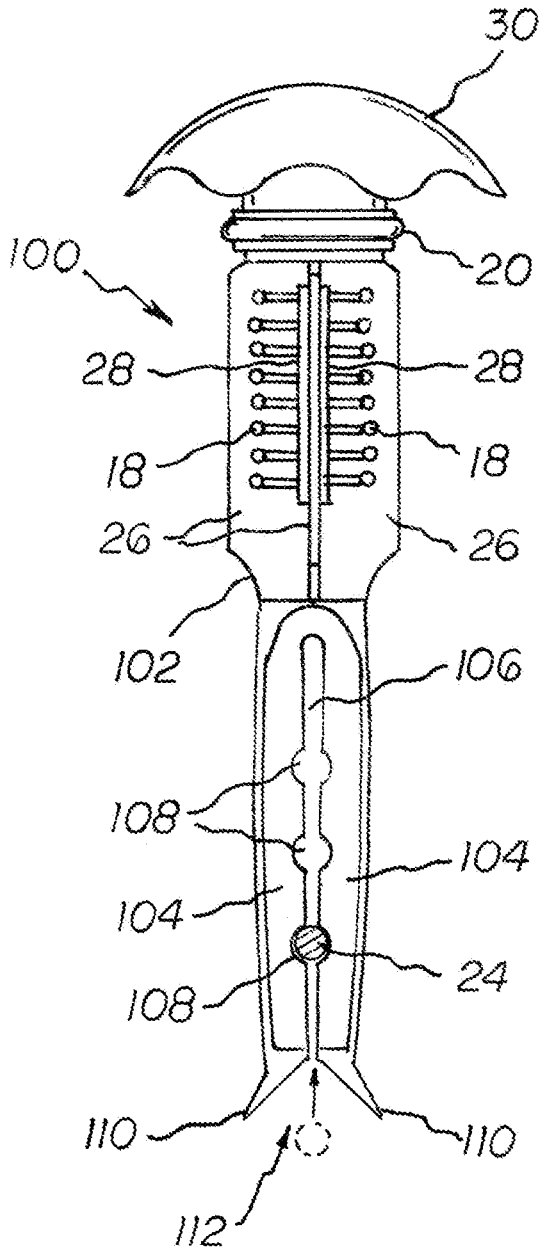
FIG. 8 is a side elevation view of popup drain stopper provided in accordance with an embodiment of the invention.
Figure 9:
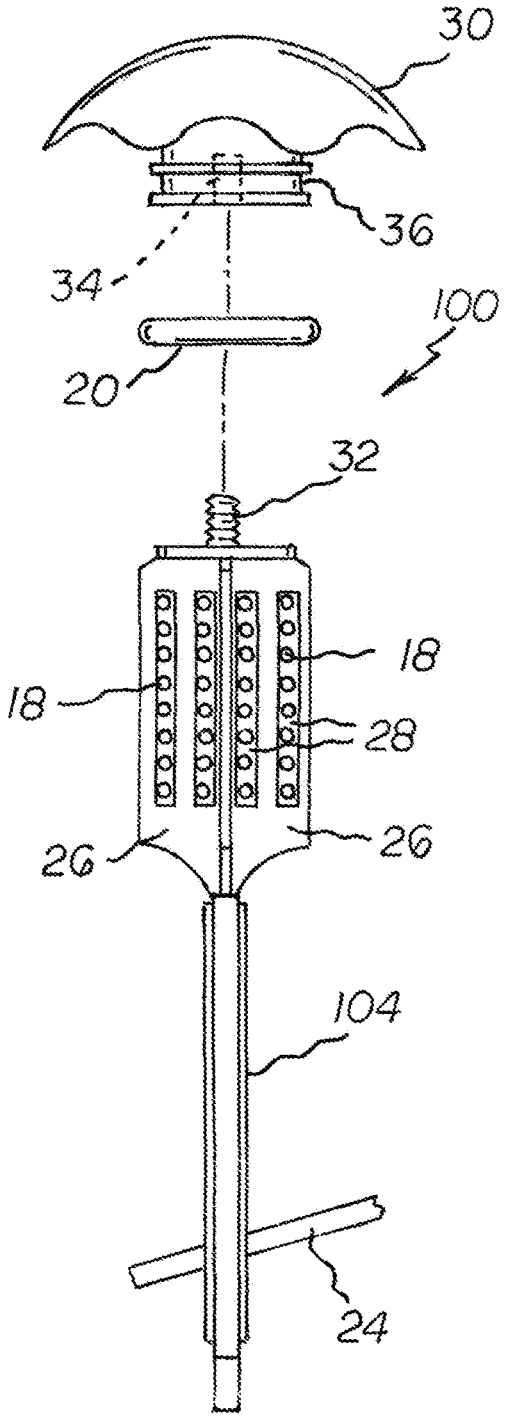
FIG. 9 is a second side elevation view of the popup drain stopper of FIG. 8, shown partially exploded.

In FIGS. 8 and 9 there is illustrated a popup drain stopper 100 in accordance with an embodiment of the invention. Stopper 100 has a construction like stopper 10 and, accordingly, like reference numbers refer to similar elements. Stopper 100 is configured to allow an easier coupling and decoupling with lever rod 24 without requiring a user to dissemble the stopper operating mechanism. Further, stopper 100 is configured to prevent an unknowledgeable user from inadvertently breaking the stopper or the lift mechanism when he or she attempts to forcefully withdraw the stopper from an associated drainpipe.

Particularly, as shown, a lower length of stem 102 of stopper 100 is bifurcated into a pair of coextending tangs 104 that are separated by a slot 106 extending from the lower end of the stem in a direction toward the stem's upper end. The slot 106 is configured to removably receive the lever rod 24 in a sliding engagement between the tangs 104 from the lower end of the stem. The slot 106 may have at least one, representatively shown three, apertures 108 spaced along the length of the slot. The apertures are configured to selectively retain the lever rod 24 at positions along the length of the slot. The width of the slot 106 narrows in a direction from the upper end toward the lower end of the stem 102 to provide a frictional engagement and retention force to the lever rod 24 against withdrawal from the slot once inserted therein.

The lower end of each tang 104 has a winglet 110 that extend in opposite directions of one another and provide a fishtail-shaped notch 112 therebetween at the lower of end of the stem 102. The fish-shaped notch 112 narrows in a direction from the lower end of the stopper toward the top end of the stopper. The winglets 110 combined with the fishtail-shaped notch 112 guide the lever rod 24 toward the open end of the slot 106. The interior surfaces of the winglets 110 contact the exterior surface of the lever rod 24 as the rod is advanced toward the slot opening which causes tangs 104 to flex outwardly from one another and open the narrow end of the slot for reception of the lever rod therein. The winglets 110 extend in the opposite directions by each having an outward surface that extends at an angle from the outward side of its respective tang 104 and terminate at a winglet tip that is disposed at an outward position relative to the outward side of the tang.

Further shown is another arrangement of the bristles 18. Particularly, the opposite surfaces of at least two fins 26 include two bristle rows 28, as opposed to a single row shown and described above.

Figure 10:
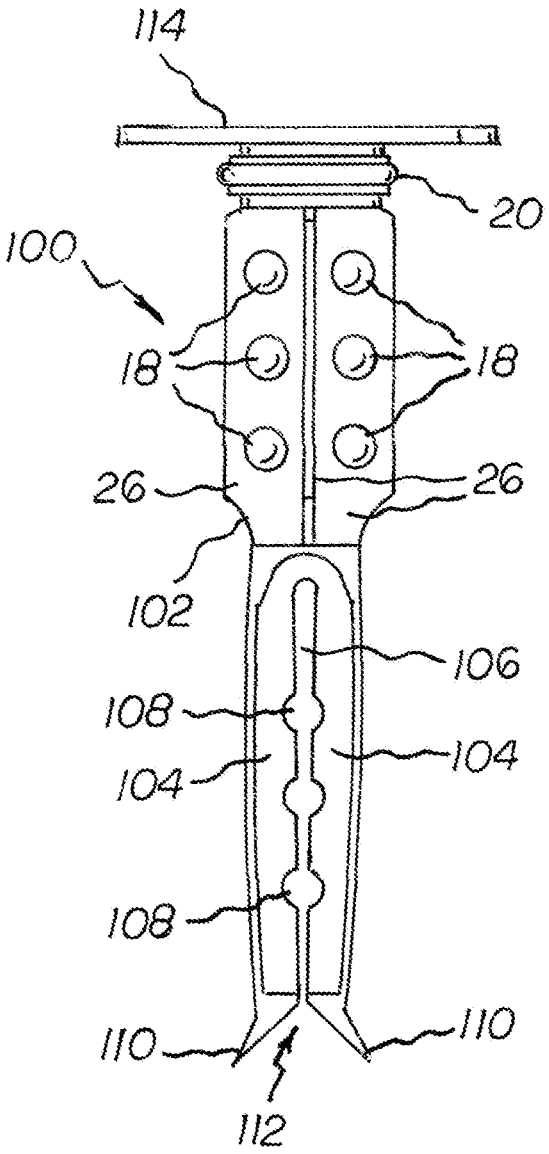
FIG. 10 is a side elevation view of popup drain stopper provided in accordance with an embodiment of the invention.
Figure 11:
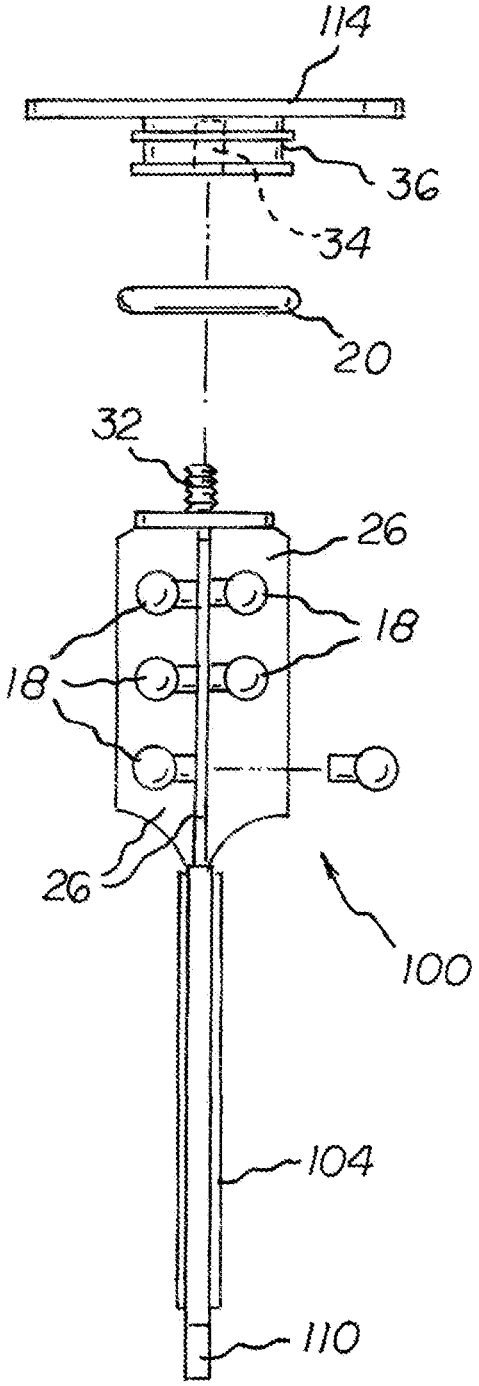
FIG. 11 is a second side elevation view of the popup drain stopper of FIG. 10, shown partially exploded.

FIGS. 10 and 11 illustrate stopper 100 with an alternative bristle arrangement. Particularly, the bristle rows 28 shown in the example comprise large bristles with large heads but a fewer number of bristles per row than the previously shown and described bristle rows. Further shown is an alternative cap 114 attached to stem 102. Cap 114, like the previously shown and described caps 19, 30, may include a threaded aperture 34 for removable attachment of the cap to the threaded stud 32 and includes a circumferential groove 36 for receiving and retaining the seal 20. Additionally, the upper end of the cap has an enlarged circular-shaped plate element 116.

Figure 12:
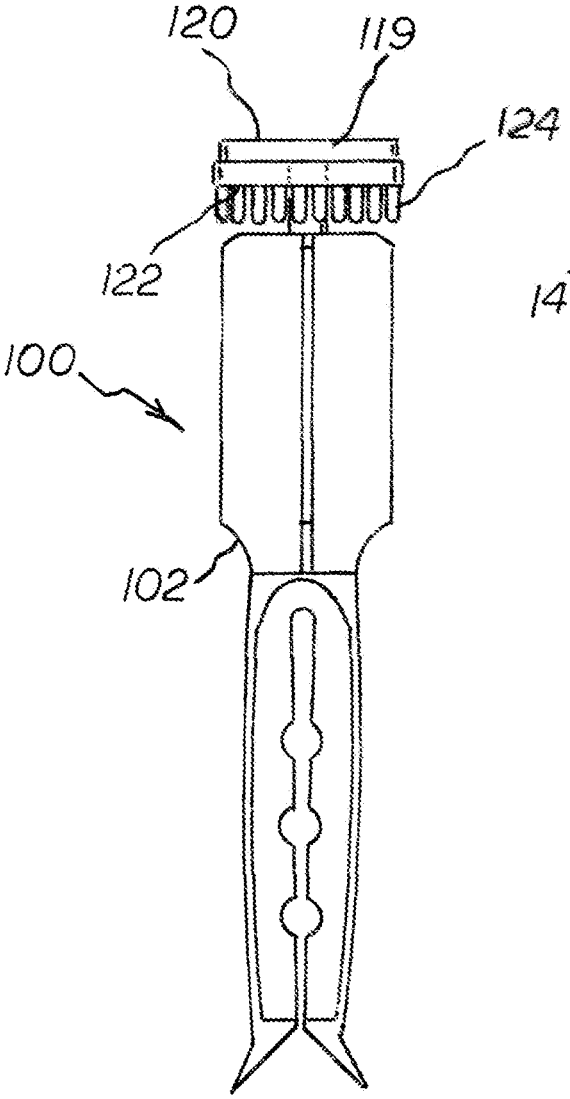
FIG. 12 is a side elevation view of popup drain stopper provided in accordance with an embodiment of the invention.
Figure 13:
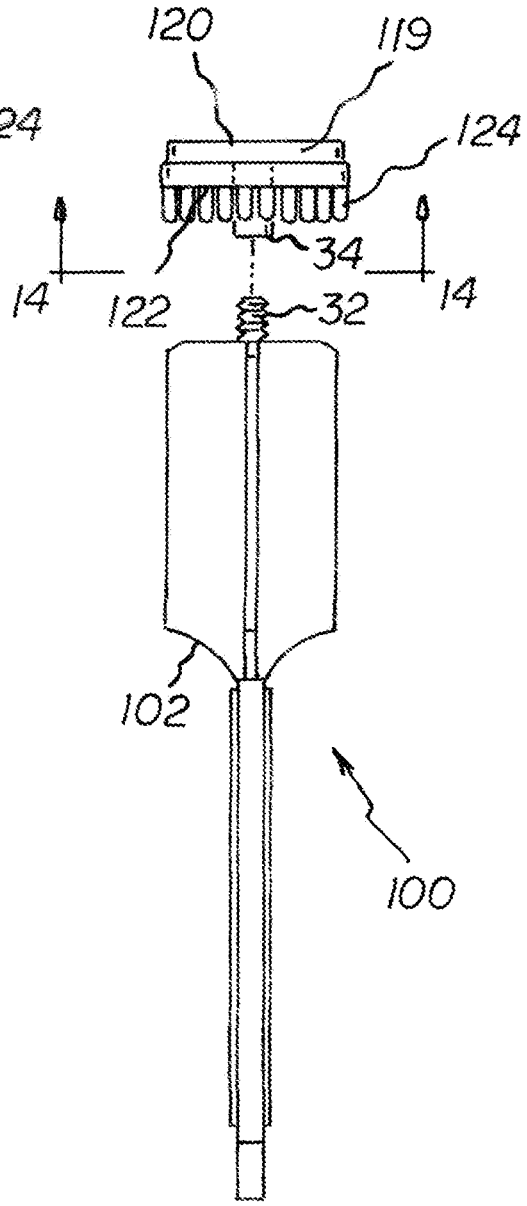
FIG. 13 is a second side elevation view of the popup drain stopper of FIG. 12, shown partially exploded.
Figure 14:
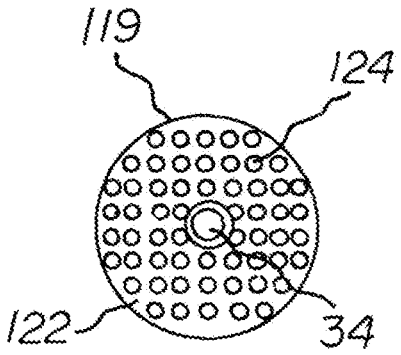
FIG. 14 is a bottom view of a cap provided in accordance with an embodiment of the invention.

FIGS. 12 and 13 illustrate stopper 100 without bristle rows 28 located on the stem 102 and with an alternative cap 118. Cap 119, like the previously described caps, may include a threaded aperture 34 for removably attachment to the threaded stud 32. With further reference to FIG. 14, cap 119 has a generally circular shaped body with a top side 120 and an opposite bottom side 122. Extending outwardly from the bottom side are a plurality of bristles 124. When the cap 119 is attached to the stem 102, the bristles 124 extend in a direction toward the bottom end of the stem and are arranged around the top of the stem. Like bristle rows 28, bristles 124 provide a debris trap for trapping, collecting, or otherwise entangling debris that flows through the drain opening 14. The debris being trapped by the bristles 124 is prevented from flowing through the drainpipe, thereby preventing clogging thereof.

Figure 15:
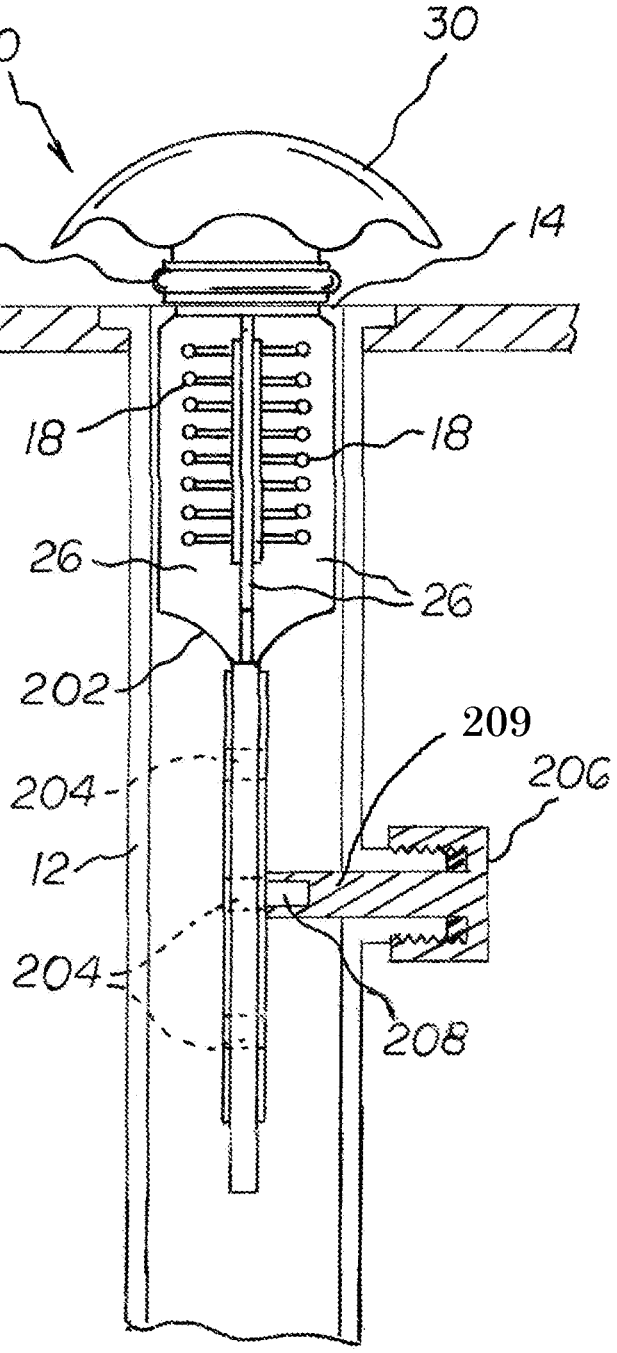
FIG. 15 is a first side elevation view, partially in cross-section, showing a popup drain stopper provided in accordance with an embodiment of the invention in a drainpipe.

FIGS. 15-17 illustrate a popup drain stopper 200 in accordance with an embodiment of the invention. Stopper 200 has a construction like stoppers 10, 100 and, accordingly, like reference numbers refer to similar elements. Stopper 200 is configured to allow for easier insertion and removal from the drainpipe 12 and is operatable without a stopper operating mechanism having a lever rod.

Particularly, as shown, a lower length of stem 202 of stopper 200 is generally planar shaped and has opposing broad flat faced providing at least one broad flat face that is configured to slide across a retaining magnet. A series of magnets 204 spaced along the stem. The magnets 204 are configured to engage with a plug 206 that is attached to the drainpipe 24 and extends into the flow passage thereof. The plug 206 can have a ferrous material 208 to which the magnets 204 are magnetically attracted. Alternatively, the material 208 could be a retaining magnet that is arranged with its magnetic poles opposite of magnets 204 to cause an attractive, magnetic force therebetween. Also, the magnets 204 could be replaced with a ferrous material that is magnetically attracted to a magnet in the plug 206. The plug has a fixed projection 209 that extends into the drainpipe 12 and the material or magnet 208 is disposed at the end of the fixed projection.

In operation, the position of the stopper 200 in the drainpipe 24 is selectively adjusted by simply pulling up or pushing down on the stopper. The stopper 200 will be held in selective positions by the magnetic force between one of the magnets 204 and the material/magnet 208. Additionally, the stopper 200 can be completely removed from the drainpipe 12 by simply pulling it upward and out of the drain opening 14.

Stopper 200 is further shown with cap 30 and bristle rows 18 located on opposite sides of at least two fins 26. Additionally, plug 206 can be configured to attach to the drainpipe 12 where the typical or conventional stopper operating mechanism, including the lever rod, is attached to the drainpipe.

Figure 20:
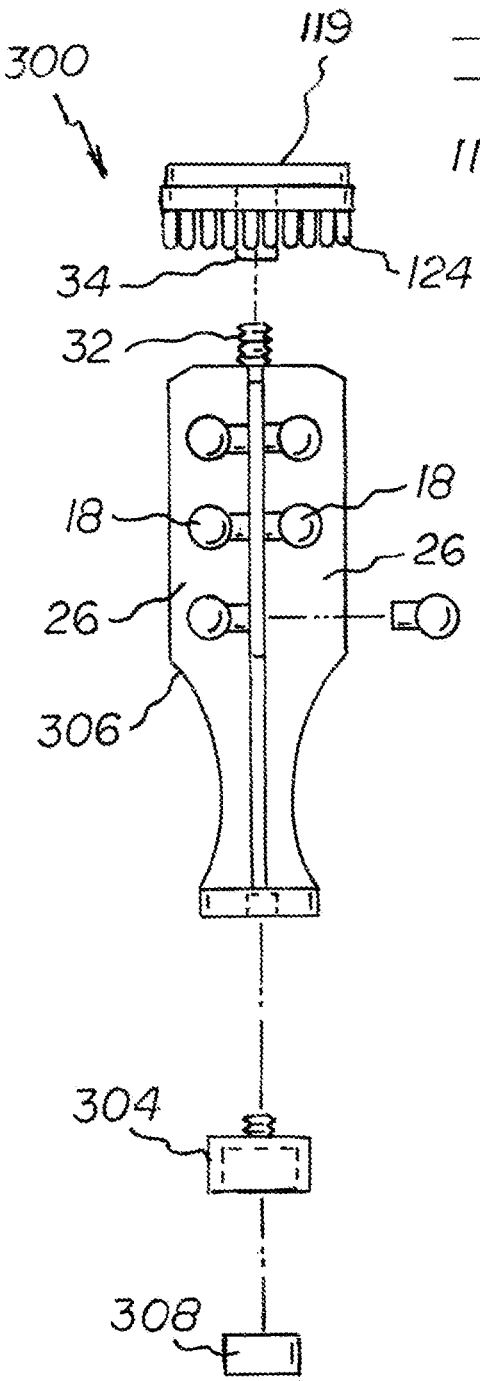
FIG. 20 is a side elevation view of the popup drain stopper of FIG. 19, shown partially exploded.
Figure 19:
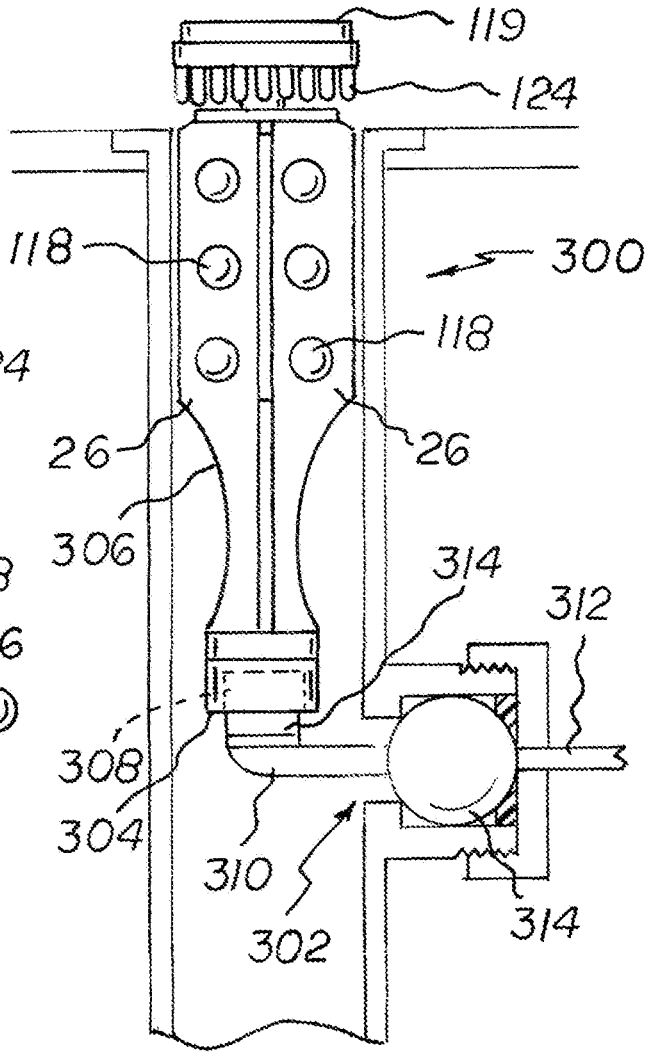
FIG. 19 is a first side elevation view, partially in cross-section, showing a popup drain stopper provided in accordance with an embodiment of the invention in a drainpipe.
Figure 21:
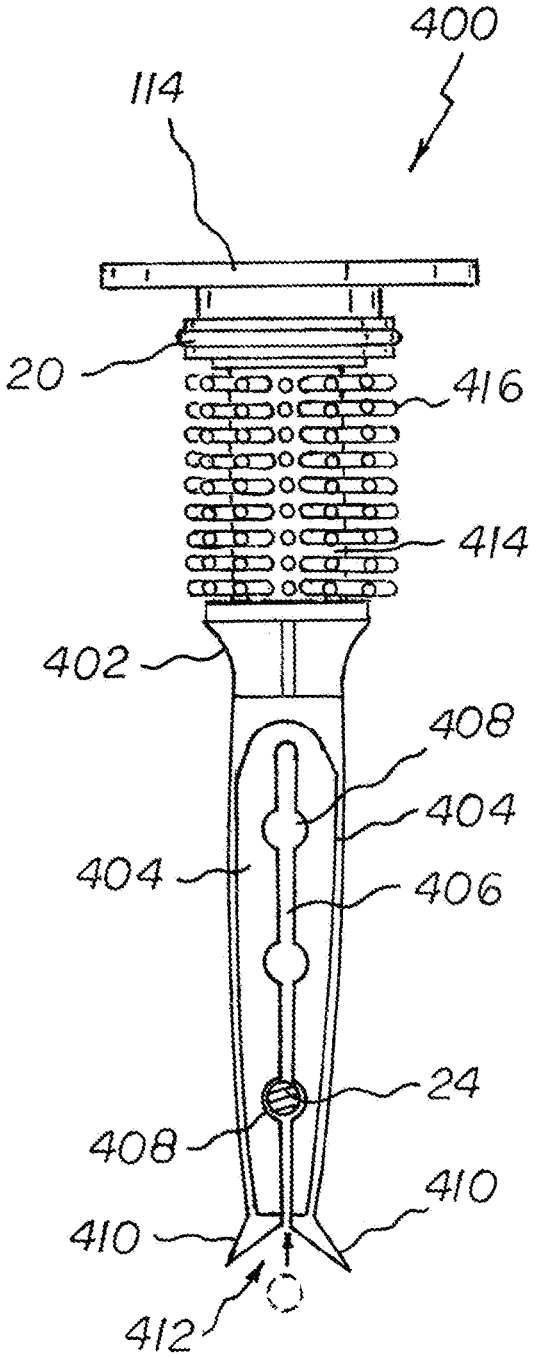
FIG. 21 is a side elevation view of a popup drain stopper provided in accordance with an embodiment of the invention.
Figure 23:
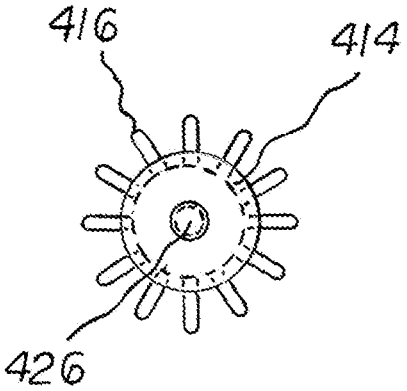
FIG. 23 is a view taken along line 23-23 in FIG. 22.
Figure 24:
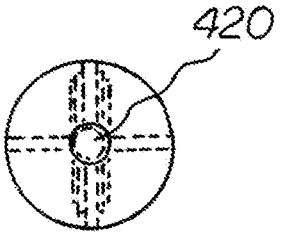
FIG. 24 is a view taken along line 24-24 in FIG. 22.

FIGS. 19 and 20 illustrated a popup drain stopper 300 and operating mechanism 302 in accordance with an embodiment of the invention. Stopper 300 has a construction like stopper 10, 100, and 200 and, accordingly, like reference numbers refer to similar elements. Stopper 300 and operating mechanism 302 are configured to allow an easier coupling and decoupling without requiring a user to dissemble the operating mechanism. Further, the stopper 300 and operating mechanism 302 are configured to prevent an unknowledgeable user from inadvertently breaking the stopper or the lift mechanism when he or she attempts to forcefully withdraw the stopper from an associated drainpipe.

Particularly, as shown, the bottom 304 of the stopper stem 306 has a magnet 308 attached therewith. The bottom 304, together with the magnet 308, are configured to removably engage with an end 310 of a lever rod 312. The lever rod end 310 has a magnet or ferrous material 314 that is magnetically attracted to the magnet 308 on the stopper stem 306. According, the magnet 308 and magnet or ferrous material 314 provide a magnetic coupling between the stopper stem 306 and the lever rod 312. The magnet 308 could be exchanged with a ferrous material that would be magnetically attracted to the magnet 314 on the lever rod end 310.

Conventionally, lever rod 312 has a ball 314 that is captively held in a socket and that allows the rod to be moved upward and downward by a connecting rod that extends upwardly, such configuration is well known in the field. Stopper 300 is further shown with cap 119 and bristle rows 18 having the large head configuration located on opposite sides of at least two fins 26.

In FIGS. 21-24 there is illustrated a popup drain stopper 400 in accordance with an embodiment of the invention. Like drain stopper 100, stopper 400 is configured to allow an easier coupling and decoupling with lever rod 24 without requiring a user to dissemble the stopper operating mechanism. Further, stopper 400 is configured to prevent an unknowledgeable user from inadvertently breaking the stopper or the lift mechanism when he or she attempts to forcefully withdraw the stopper from an associated drainpipe.

Particularly, as shown, a lower length of stem 402 of stopper 100 is bifurcated into a pair of coextending tangs 404 that are separated by a slot 406 extending from the lower end of the stem in a direction toward the stem's upper end. The slot 406 is configured to removably receive the lever rod 24 in a sliding engagement between the tangs 404 from the lower end of the stem. The slot 406 may have at least one, representatively shown three, apertures 408 spaced along the length of the slot. The apertures are configured to selectively retain the lever rod 24 at positions along the length of the slot. The width of the slot 406 narrows in a direction from the upper end toward the lower end of the stem 402 to provide a frictional engagement and retention force to the lever rod 24 against withdrawal from the slot once inserted therein.

The lower end of each tang 404 has a winglet 410 that extend in opposite directions of one another and provide a fishtail-shaped notch 412 therebetween at the lower of end of the stem 102. The fish-shaped notch 412 narrows in a direction from the lower end of the stopper toward the top end of the stopper. The winglets 410 combined with the fishtail-shaped notch 412 guide the lever rod 24 toward the open end of the slot 406. The interior surfaces of the winglets 410 contact the exterior surface of the lever rod 24 as the rod is advanced toward the slot opening which causes tangs 404 to flex outwardly from one another and open the narrow end of the slot for reception of the lever rod therein.

Stopper 400 further includes a cylindrically shaped bristle body 414 having a plurality of bristles 416 arranged in a plurality of rows such that the bristles are arranged around the entire body and radially project outwardly therefrom. The body 414 is removably attached to the stem 402 at the body's bottom end 418 by a threaded coupling having a threaded post 420 on the stem and a cooperating threaded bore 422 formed through the bottom of the body.

A cap, such as cap 114 is removably attached to the top end 424 of the body 414 by a threaded coupling having a threaded post 426 on the top end of the body 414 and a cooperating threaded bore 34 in a bottom of the cap. As described previously, cap 114 can have an O-ring 20 for sealing with a drain opening.

Figure 22:
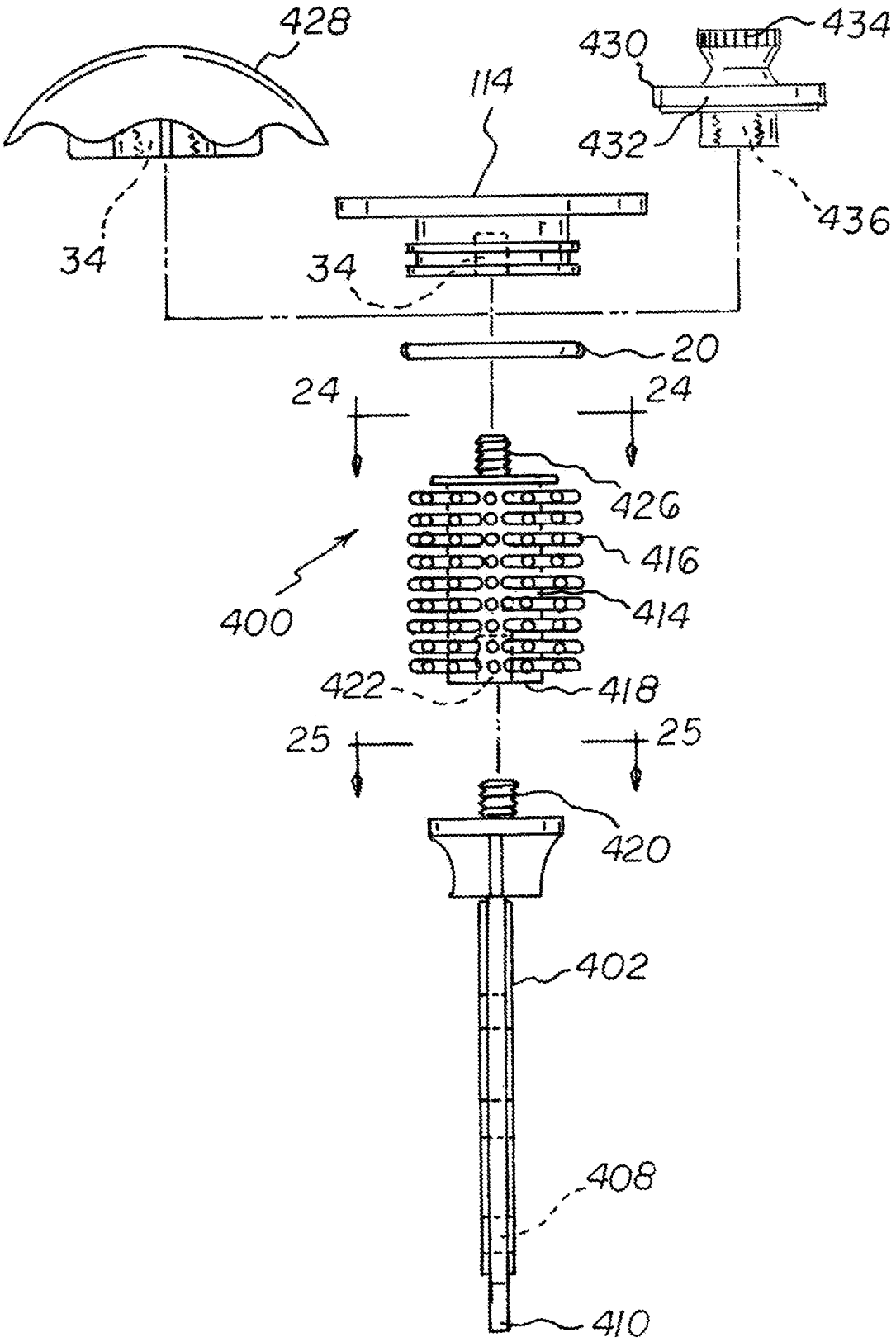
FIG. 22 is a second side elevation view of the popup drain stopper of FIG. 21, shown exploded.

As further shown in FIG. 22, a cap 428 that is like cap 30 can be provided for attachment to body 414. Cap 428 is umbrella shaped like cap 30 but does not include an O-ring seal like cap 30. A cap 430 can also be provided for attachment to body 414. Cap 430 has a disk-shaped top 432 with a knob 434 extending upwardly from the cap. The knob 434 is configured to be grasped by a user to move the stopper 400 inwardly and outwardly from a drain opening. The cap 430 includes a threaded bore 436 on a bottom end for threaded coupling with post 426 on body 414.

The construction of stopper 400 allows disassembly thereof for easy cleaning of the bristles 416 from captured debris like hair and/or replacement of the bristle body without requiring replacement of the entire stopper assembly.

While not shown, stem 402 of stopper 400 could be configured to be any of the stems that are have been described herein. For example, stem 402 could be configured with like stem 202 of stopper 200 to include the magnet 204 configuration. Similarly, stem 402 could be configured like stem 306 of stopper 300 to include the magnet 308 configuration.

Figure 25:
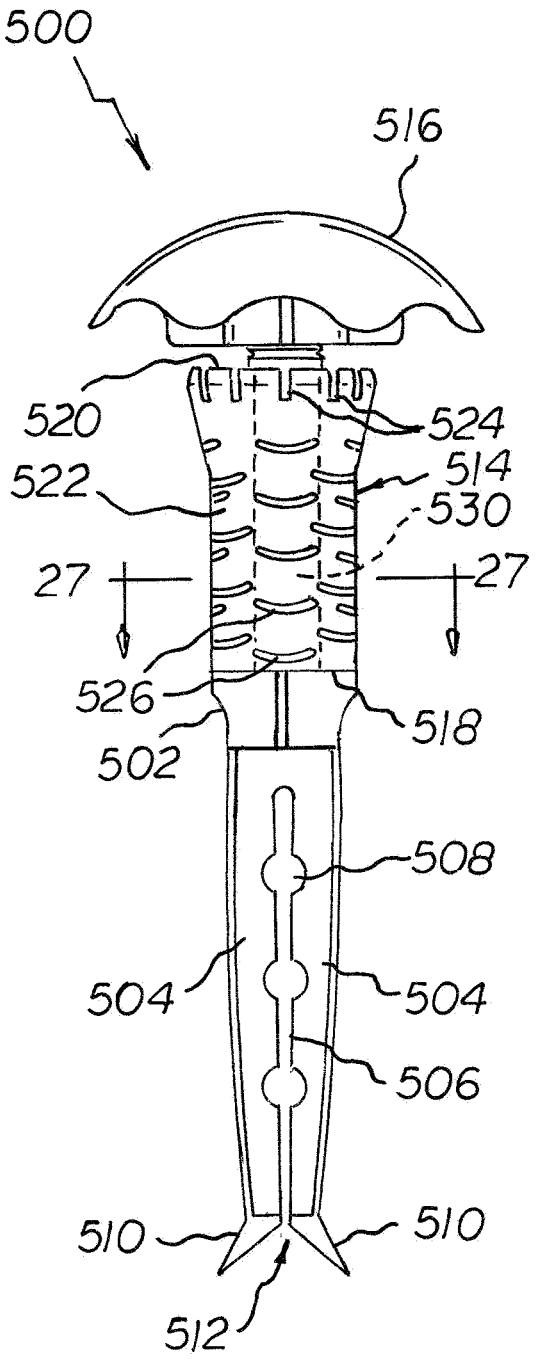
FIG. 25 is a side elevation of a popup drain stopper provided in accordance with another embodiment of the invention.
Figure 26:
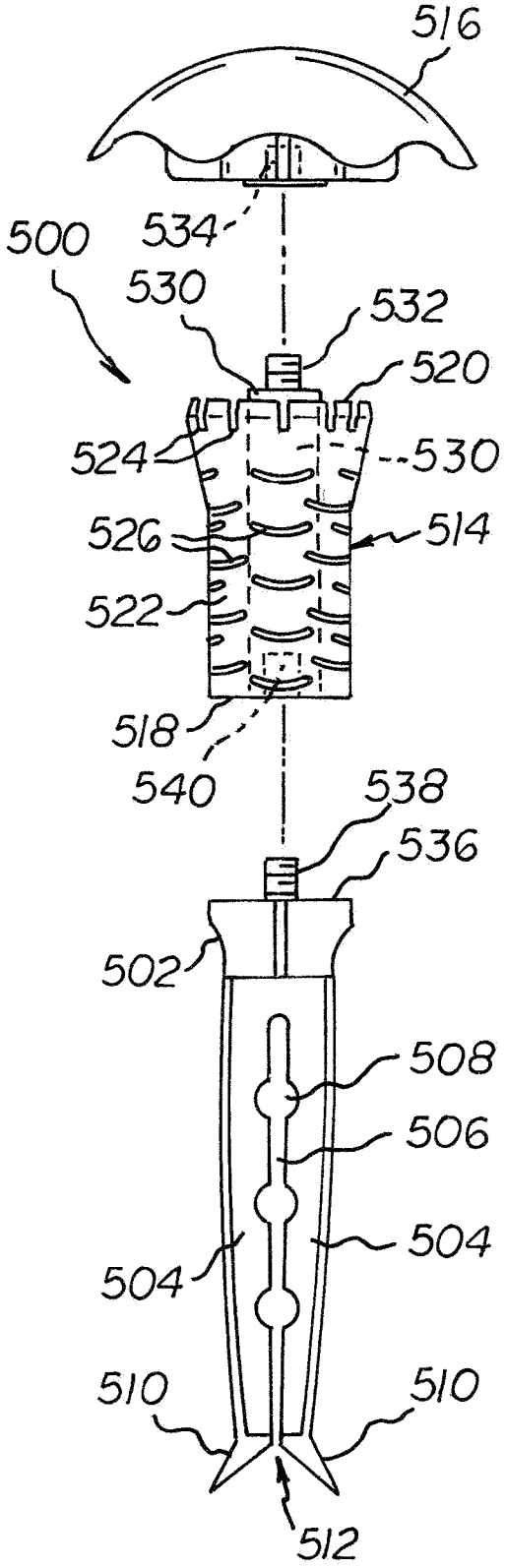
FIG. 26 is a side elevation view of the popup drain stopper of FIG. 25, shown exploded.
Figure 27:
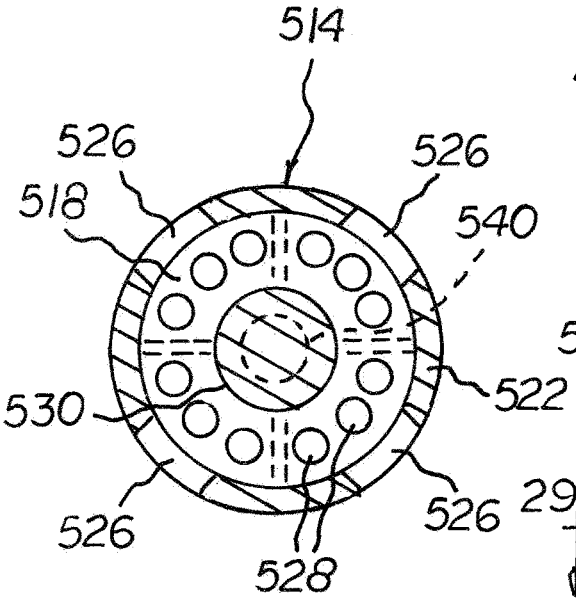
FIG. 27 is a cross-sectional view taken along line 27-27 in FIG. 25.

In FIGS. 25-27 there is illustrated a popup drain stopper 500 in accordance with an embodiment of the invention. Like the previously described drain stoppers, stopper 500 is configured to be disposed in the interior of a conventional drainpipe having a drain opening through which the stopper is inserted for up and down movement within the interior of the drainpipe to selectively seal the drain opening.

Drain stopper 500 includes a stem 502, a debris collection basket 514, and a cap 516. Stem 502 can include any of the stem configurations described previously. Representatively illustrated, stem 502 has a similar construction and operation of stem 102 described in reference to FIGS. 8 and 9 above. Particularly, the stem is configured to allow an easier coupling and decoupling with lever rod (not shown) without requiring a user to dissemble the stopper operating mechanism. Further, stopper 500 is configured to prevent an unknowledgeable user from inadvertently breaking the stopper or the lift mechanism when he or she attempts to forcefully withdraw the stopper from an associated drainpipe.

Like previously described stems, a lower length of stem 502 of stopper 500 is bifurcated into a pair of coextending tangs 504 that are separated by a slot 506 extending from the lower end of the stem in a direction toward the stem's upper end. The slot 506 is configured to removably receive the lever rod in a sliding engagement between the tangs 504 from the lower end of the stem. The slot 506 may have at least one, representatively shown three, apertures 508 spaced along the length of the slot. The apertures are configured to selectively retain the lever rod at positions along the length of the slot. The width of the slot 506 narrows in a direction from the upper end toward the lower end of the stem 502 to provide a frictional engagement and retention force to the lever rod against withdrawal from the slot once inserted therein.

The lower end of each tang 504 has a winglet 510 that extend in opposite directions of one another and provide a fishtail-shaped notch 512 therebetween at the lower of end of the stem 502. The fish-shaped notch 512 narrows in a direction from the lower end of the stopper toward the top end of the stopper. The winglets 510 combined with the fishtail-shaped notch 512 guide the lever rod toward the open end of the slot 506. The interior surfaces of the winglets 510 contact the exterior surface of the lever rod as the rod is advanced toward the slot opening which causes tangs 504 to flex outwardly from one another and open the narrow end of the slot for reception of the lever rod therein.

Basket 514 is configured to collect debris in water following through the drainpipe when the stopper is disposed therein to prevent clogging of the drain. Debris collected by the basket can be easily disposed of by simply removing the stopper 500 from the drainpipe and disposing the material collected in the basket. In embodiments, the basket 514 may be configured to allow it to be detached from the stopper. Once removed, the basket could be discarded and replaced by a new stopper.

As representatively shown, strainer basket 514 has a cylindrical shape and has a bottom wall 518, an open top end 520, and a sidewall 522 extending therebetween. In embodiments, the sidewall 522 may taper outwardly at the top end to allow an upper portion of the sidewall to abut against the inner surface of the drainpipe when the stopper 500 is disposed therein. A plurality of slits or slots 524 may be provided in the sidewall 522 around the circumference of the top end. The slots 524 allow the tapered portion to slightly flex inwardly to form a tight interference or friction fit against the inner surface of the drainpipe which prevents debris from flowing past the basket.

As further shown, a plurality of first apertures 526 are formed through the sidewall 522. The apertures 526 are formed through the sidewall such that apertures 526 are in a spaced pattern that extends around the circumference of the sidewall and between the bottom and top end. Representatively shown, apertures 526 are semi-circular shaped. Further, a plurality of second apertures 528 can be provided at spaced intervals in the bottom wall 518. Representatively shown, apertures 528 are circular shaped. The first and second apertures 526 and 528 are sized to catch debris from the water as it flows into the open top end and then through the apertures.

As mentioned above, the stopper 500 and basket 514 can be configured such that the basket is removable. In the representatively illustrated embodiment, the basket 514 can have a post 530 that is centrally disposed within the interior of the basket and extends from the bottom 518 and terminates at a free end approximate the top end 520. The post 530 can be threaded or have a threaded stud 532 and the bottom end of the cap 516 may have a corresponding threaded aperture 534 to threadedly attach the cap to the post. As further shown, a top end 536 of the stem 502 can have a threaded stud 538 and the bottom 518 of the basket may have a corresponding threaded aperture 540 to threadedly attach the basket to the stem.

Figure 29:
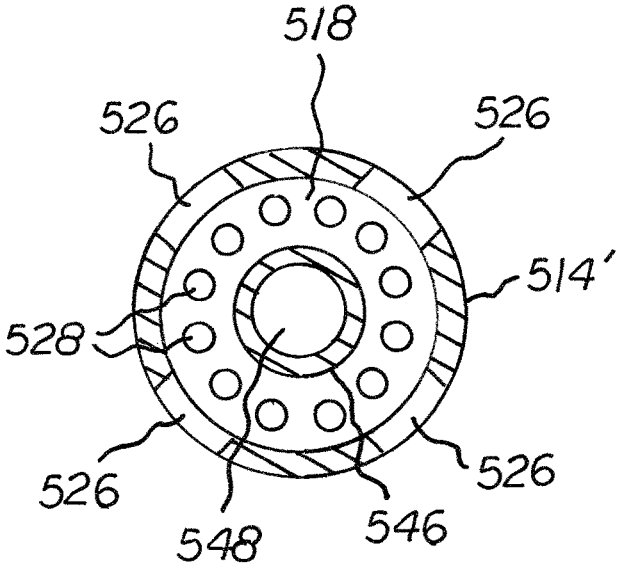
FIG. 29 is a cross-sectional view taken along line 29-29 in FIG. 28.
Figure 28:
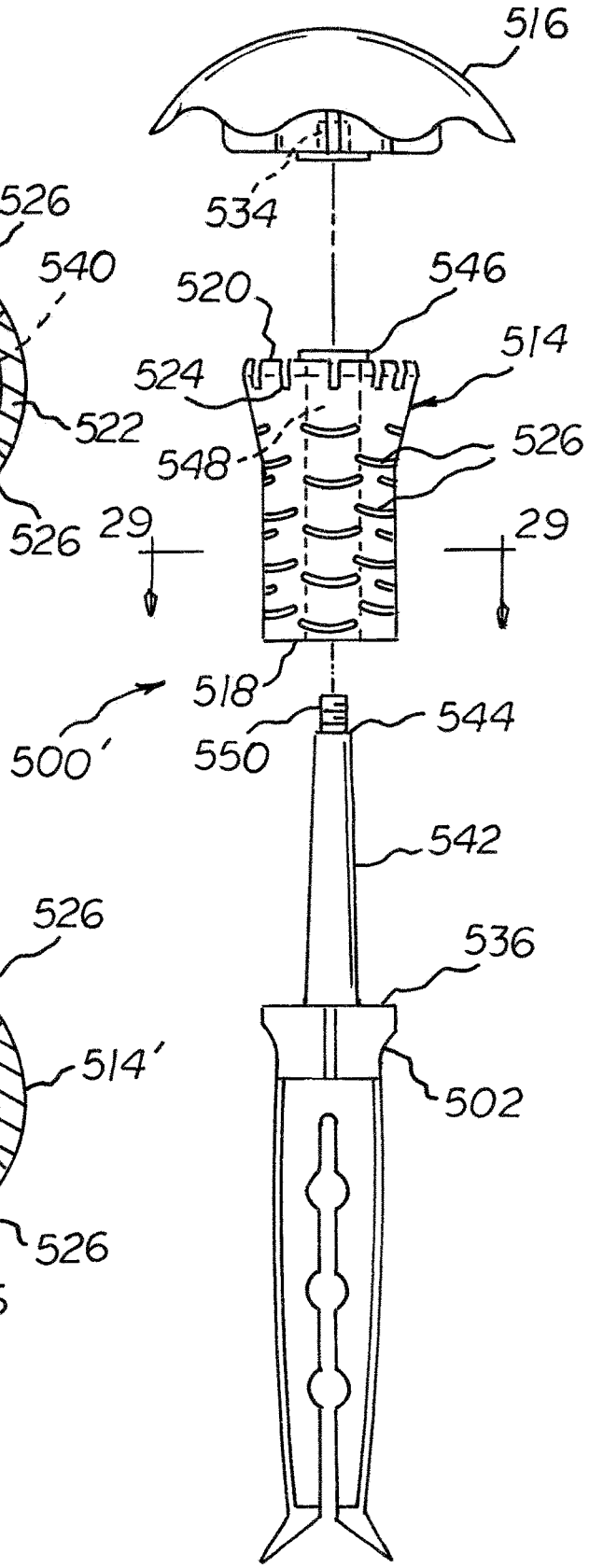
FIG. 28 is a side elevation view of a popup drain stopper in accordance with another embodiment of the invention, shown exploded.

In FIGS. 28 and 29 an alternative configuration of stopper 500 is shown as stopper 500' and in which like reference numbers refer to similar elements. Here, stem 502 has a post 542 that extends upwardly from top 536 and terminates at a free end 544. Basket 514' has a centrally located sleeve 546 which replaces post 530 of basket 514. Sleeve 546 has a bore 548 that extends through the length there of and which is configured to removably receive post 542. That is, basket 514' is attached to stem 502 by sliding the basket 514' on the post 542 such that the post extends through the bore 548. End 544 can have a threaded stud 550 that can be threadedly received by threaded aperture 534 in cap 516 to removably secure the basket 514' to the stem 502.

Figure 30:
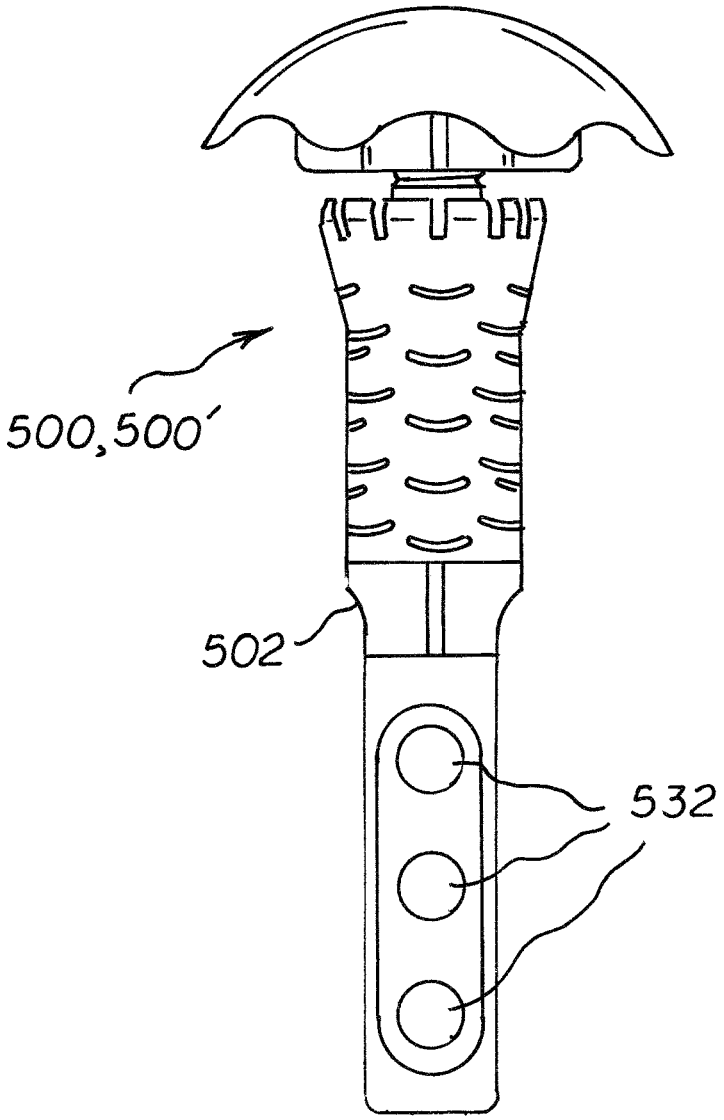
FIG. 30 a side elevation view of a popup drain stopper in accordance with another embodiment of the invention.
Figure 31:
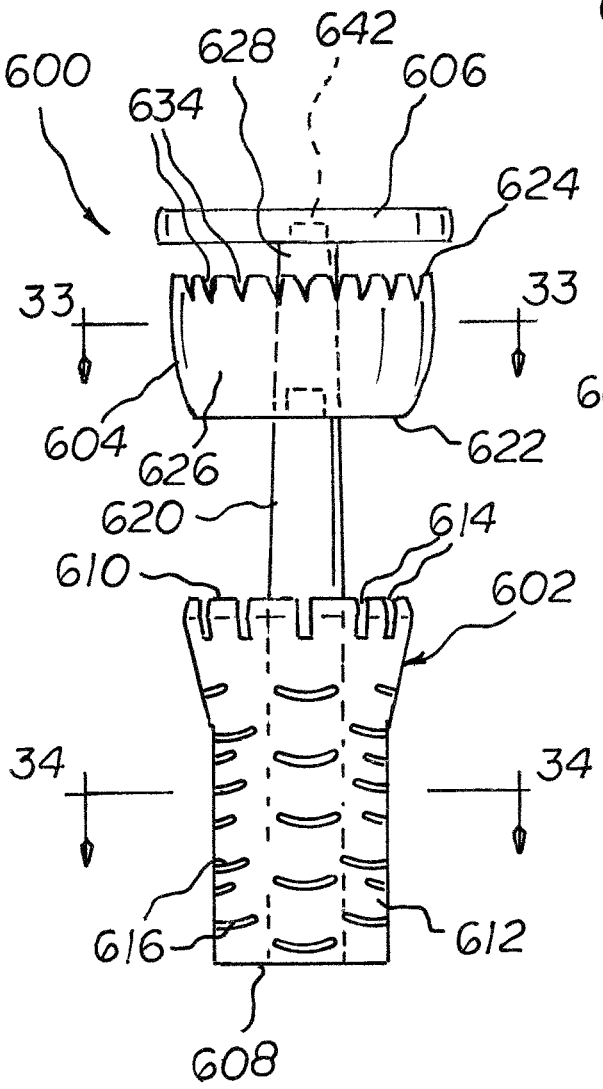
FIG. 31 is a side elevation view of a popup drain stopper in accordance with another embodiment of the invention.

Stoppers 500 or 500' could be configured to have any of the stems that have been described herein. For example, stem 502 could be configured like stem 202 of stopper 200 to include the magnet configuration as described and explained above. This configuration is representatively shown in FIG. 30, wherein elements 552 represent the magnets.

Like the previously described embodiments, stoppers 500 and 500' can have a different stem configuration than the configuration particularly shown in FIGS. 25-27 and 28-29, respectively. Particularly, stoppers 500 and 500' could have the magnetic stem configuration as shown in FIG. 15, as representatively shown in FIG. 30.

In FIGS. 31-34 there is illustrated a popup drain stopper 600 in accordance with an embodiment of the invention. Stopper 600 includes a debris collecting basket 602, a centering element 604, and a cap 606.

Basket 602 has a similar construction and purpose as previously described basket 514. Basket 602 has a cylindrical shape and has a bottom wall 608, an open top end 610, and a sidewall 612 extending therebetween. In embodiments, the sidewall 612 may taper outwardly at the top end to allow an upper portion of the sidewall to abut against the inner surface of the drainpipe when the stopper 600 is disposed therein. A plurality of slits or slots 614 may be provided in the sidewall 612 around the circumference of the top end. The slots 614 allow the tapered portion to slightly flex inwardly to form a tight interference or friction fit against the inner surface of the drainpipe which prevents debris from flowing past the basket.

As further shown, a plurality of first apertures 616 are formed through the sidewall 612. The apertures 616 are formed through the sidewall such that apertures are in a spaced pattern that extends around the circumference of the sidewall and between the bottom and top end. Representatively shown, apertures 616 are semi-circular shaped. Further, a plurality of second apertures 618 can be provided at spaced intervals in the bottom wall 608. Representatively shown, apertures 608 are circular shaped. The first and second apertures 616 and 618 are sized to catch debris from the water as it flows into the open top end and then through the apertures.

Basket 602 may further include a central post 620 that extends from the bottom wall 608 and terminates at a free end at a spaced distance from the top end 610 of the basket. Attached to the post 620 is a centering element 604 which operates to help center the stopper 600 in a drainpipe. The centering element 604 is generally cylindrical shape has a bottom 622, a top 624, and a sidewall 626 that is disposed outwardly from the central post 620. The centering element 604 further has a centrally located shaft 628 that is attached to the sidewall 626 by a plurality of circumferentially spaced flanges 630. Flow passages 632 are located between the sidewall 626 and the shaft 628 through which water is free to flow through the centering element.

In embodiments, a plurality of notches or slots 634 may be disposed in the sidewall 626 around the top end 624. The slots 634 allow the sidewall 626 at the top end to flex in a direction inwardly to form an interference fit with the inner sidewall of a drainpipe in which the stopper 600 is inserted. That is the slots 634 allow the sidewall 626 at the top end to somewhat flex and conform to the inner diameter of the drainpipe, which serves to center the stopper 600 in the drainpipe.

Figure 32:
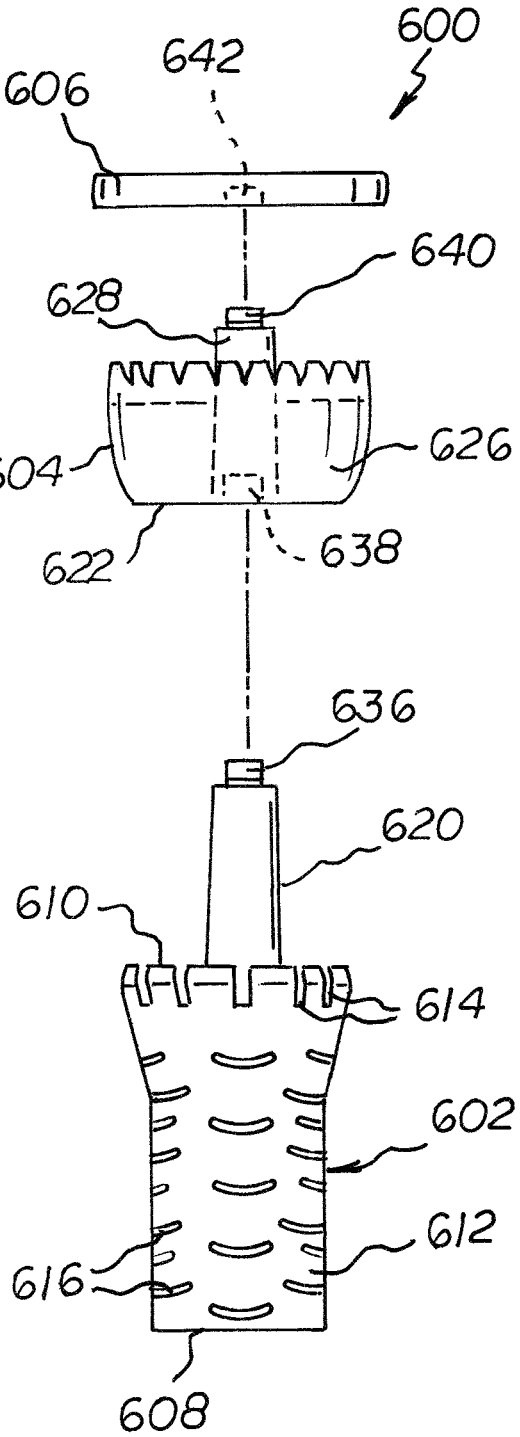
FIG. 32 is a second side elevation view of the popup drain stopper of FIG. 31, shown exploded.
Figure 33:
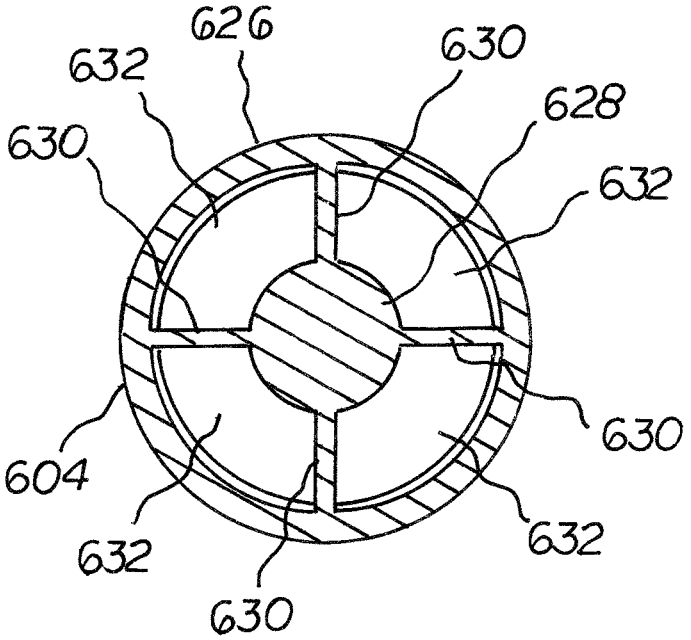
FIG. 33 is a cross-sectional view taken along line 33-33 in FIG. 31.
Figure 34:
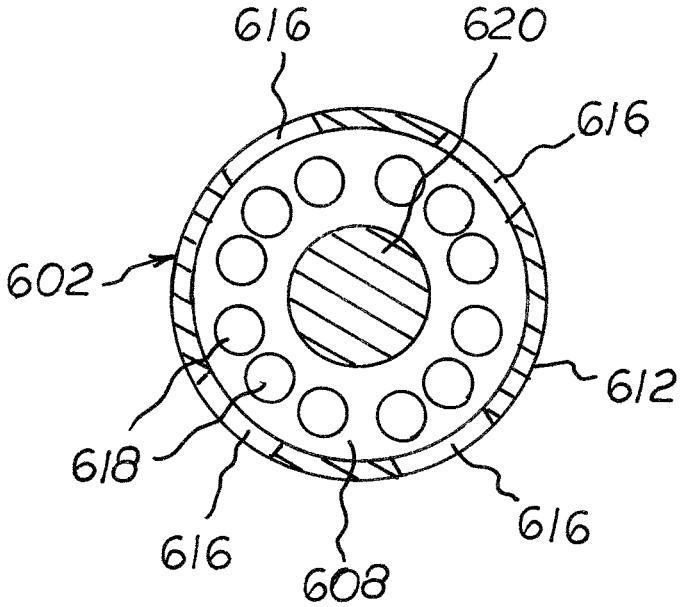
FIG. 34 is a cross-sectional view taken along line 34-34 in FIG. 31.

As best seen in FIG. 32, and like previously described stopper configurations, stopper 600 may be configured to be disassembled. In such a configuration, the top of post 620 may have a threaded stud 636 that is threadedly received by a threaded bore 638 on the bottom of the centering element 604. And the top of shaft 628 may have a threaded stud 640 that is threadedly received by a threaded bore 642 on the bottom of the cap 606. In this configuration, the centering element 604 can be removed from the basket 602 and the cap 606 can be removed from the centering element. Removing the basket 602 can allow to replacement of the basket or make emptying it of debris easier.

Figure 35:
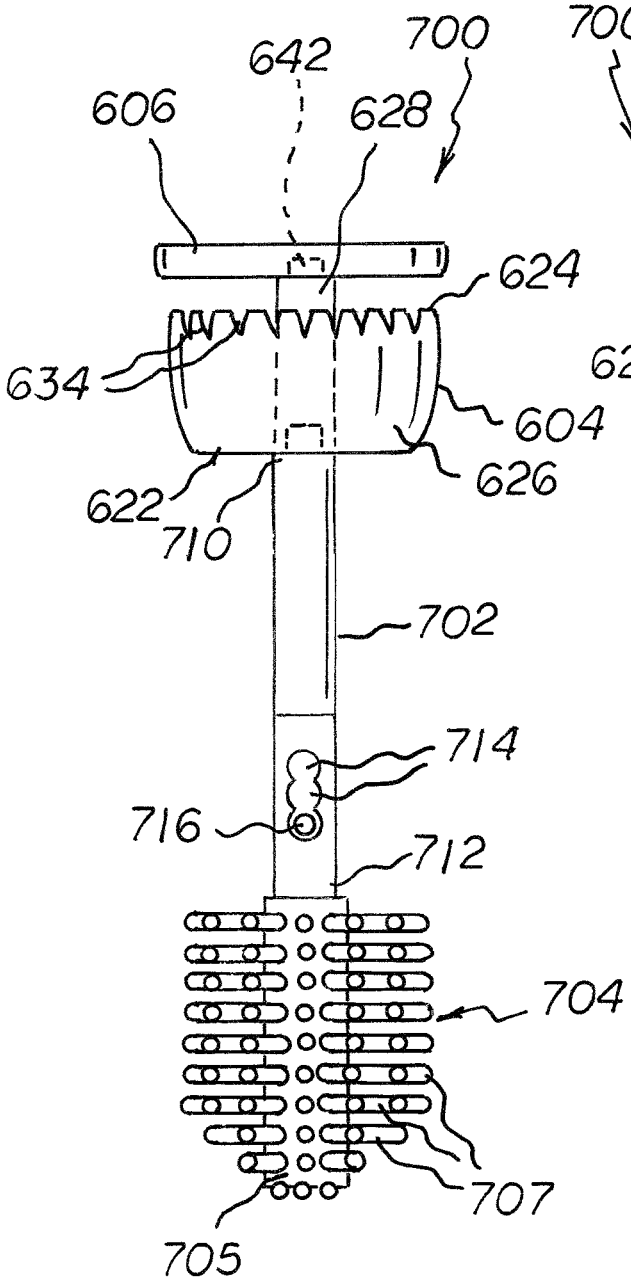
FIG. 35 is a side elevation view of a popup drain stopper in accordance with another embodiment of the invention.
Figure 36:
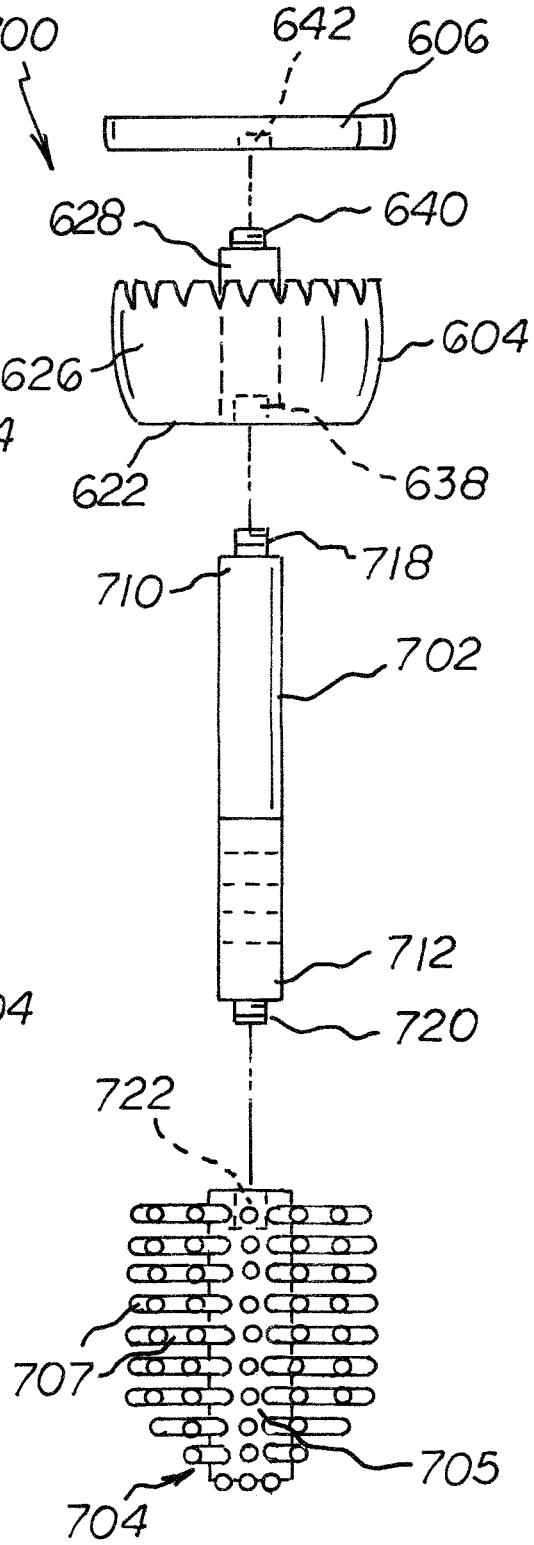
FIG. 36 is a second side elevation view of the popup drain stopper of FIG. 34, shown exploded.

In FIGS. 35 and 36 there is illustrated a popup drain stopper 700 in accordance with an embodiment of the invention. Like the previously described stoppers, stopper 700 is configured to be inserted into a drainpipe and to collect debris flowing into the drainpipe to prevent clogging of the drain. As representatively shown, stopper 700 has a post or stem 702, a bristle head 704, centering element 604, and a cap 606.

Stem 702 has a top end 710, a bottom end 712, and an elongated body extending between the top and bottom ends. A plurality of apertures 714, representatively three apertures, are formed through the stem 702 toward the bottom end 712. Apertures 714 are configured to receive a lever rod 716 to raise and lower the stopper 700 in the drainpipe in a manner previously described. The apertures 714 may be connected at their circumference to adjacent apertures to allow the lever rod 716 to be selectively positioned in a desired apertured by sliding the lever rod between the connected apertures in a snap-like, friction manner.

Centering element 604 is disposed at the top end 712 of stem 702 and, like with stopper 600, functions to help center stopper 700 in the drainpipe. Centering element 604 has the same construction and purpose as described above in connection with stopper 600 and does not require repeating here.

Bristles head 704 is disposed at the bottom end 712 of the stem 702. As representatively shown, bristle head 704 has a central, elongated body 705 and a plurality of bristles 707 arranged on the body. The bristles 707 are generally arranged in a cylindrical configuration about and along the body 705 and are further arranged to form a flat surface at the top of the body and a domed surface at the bottom of the body, as shown. Bristles 707 function like the bristles previously described and that is to catch debris flowing through the drainpipe to prevent clogging and to allow easy removal of the debris from the drainpipe.

As best seen in FIG. 36, and like previously described stopper configurations, stopper 700 may be configured to be disassembled. In such a configuration, the top of stem 702 may have a threaded stud 718 that is threadedly received by a threaded bore 638 on the bottom of the centering element 604. The bottom of stem 702 may have a threaded stud 720 that is threadedly received by a threaded bore 722 on the top of the bristle head body 705.

Figure 37:
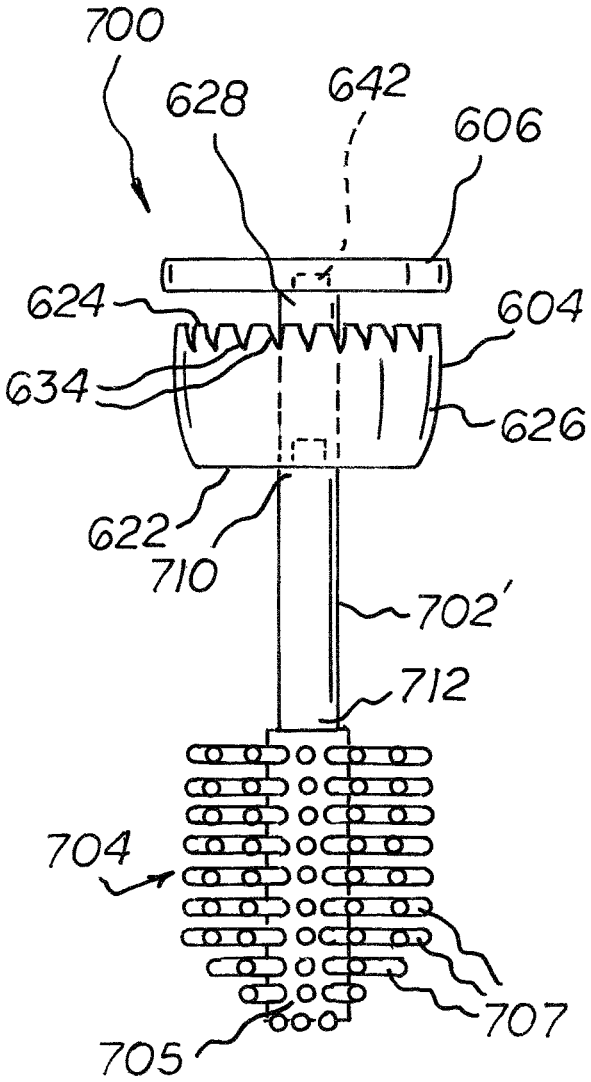
FIG. 37 is a side elevation view of a popup drain stopper in accordance with another embodiment of the invention.
Figure 38:
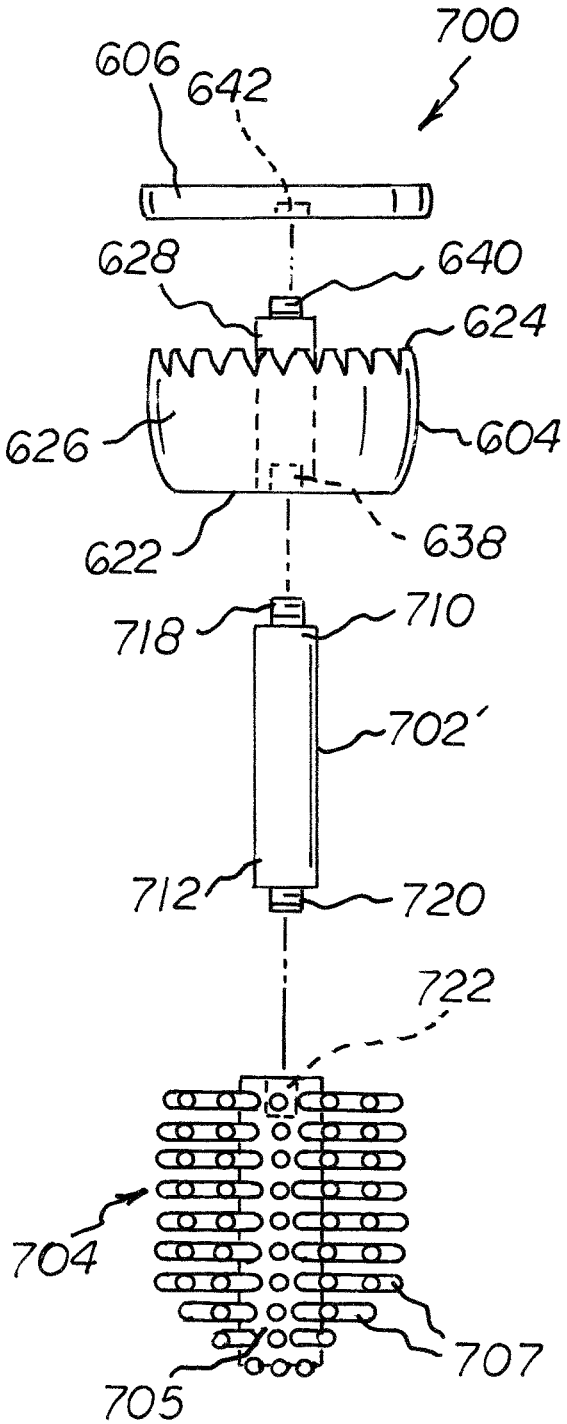
FIG. 38 is a second side elevation view of the popup drain stopper of FIG. 36, shown exploded.

In FIGS. 37 and 38 an alternative configuration of stopper 700 is shown. In this configuration, stem 702 is replaced with stem 702'. Stem 702' is like stem 700 but does not include the plurality of apertures 714.

Figure 39:
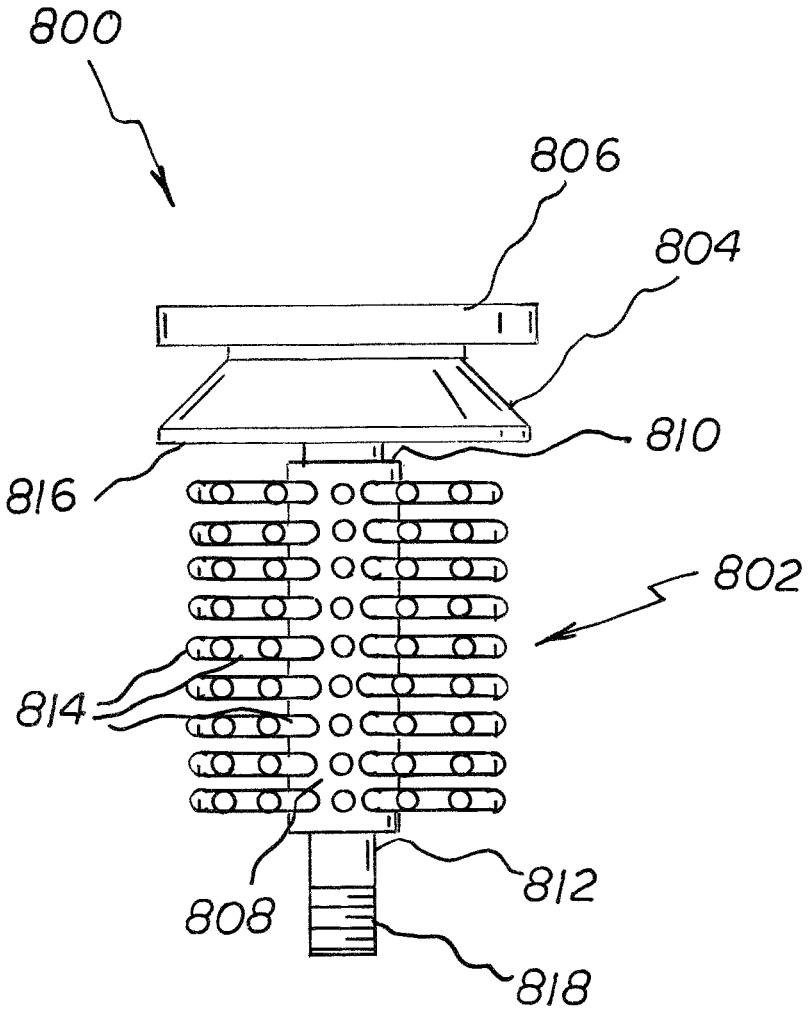
FIG. 39 is a side elevation view of a popup drain stopper in accordance with another embodiment of the invention.

In FIG. 39 there is illustrated a drain stopper 800 in accordance with an embodiment of the invention. Stopper 800 is configured for use with a threaded tub drain, the configuration of tub drains is well known in the field of the invention, in which the stopper is threaded to seal or open the drain.

As representatively shown, stopper 800 includes a bristle head 802, a seal flange 804, and cap 806. The bristle head 802 is configured to be disposed in the tub drain opening and collect debris flowing into the drain opening to prevent drain clogging and allow easy removal of the debris. The bristle head 802 has a cylindrically shaped elongated body or stem 808 having a top end 810 and a bottom end 812. A plurality of bristles 814 are arranged about and along the stem 808 forming a generally cylindrically array of bristles, as shown. Bristles 814 function like the bristles previously described and that is to catch debris flowing through the drainpipe to prevent clogging and to allow easy removal of the debris from the drainpipe.

The seal flange 804 is disposed at the top of the bristle head 802 and has a circular circumference to conform to the inner diameter of the tub drain. An O-ring or sealing element 816 is secured around the flange's circumference to provide a sealing contact with the inner diameter of the tub drain. The cap 806 is disposed at the top of the stopper 800. The bottom of the bristle head 802 has a threaded stud portion 818 that is configured to be threadedly received by a corresponding threaded bore in the tub drain.

While not shown, stopper 800 could be configured to work with a drop-in style tub drain, in which the stopper 800 would not have the threaded stud at the bottom of the bristle head.

Many different embodiments and configurations have been disclosed in connection with the above description and the drawings. It is important to note that aspects from one embodiment may be used with other embodiments. For example, the foregoing description describes many different cap configurations and many different stopper configurations. It shall be understood that any one cap configuration can be used with any one stopper configuration. Similarly, many different bristle configurations are described herein. It shall be understood that any bristle configuration could be used in connection with any stopper configuration.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a sub-combination or variation of a sub-combination.

It will be appreciated by persons skilled in the art that the present embodiment is not limited to what has been particularly shown and described hereinabove. A variety of modifications and variations are possible in light of the above teachings without departing from the following claims.

What is claimed is:

1. A popup drain stopper comprising:

a stem configured to move vertically within a drainpipe between an open position and a sealing position in which the drainpipe is sealed, the stem having a top end, a bottom end, a length extending therebetween;

a cylindrically shaped strainer basket having a closed bottom end, an open top end, and a sidewall extending between the closed bottom end and the open top end, a plurality of first apertures formed therethrough about a circumference of the sidewall and between the closed bottom end and the open top end, and a plurality of second apertures formed therethrough through the closed bottom end;

wherein the sidewall has a tapered portion that tapers from narrow to wide in a direction toward the open top end such that a first diameter of the sidewall at the open top end is greater than a second diameter of the sidewall at the closed bottom end;

wherein the strainer basket has an edge that circumscribes the open top end, and a plurality of slots spaced circumferentially around the sidewall, the slots extending through the edge and along a length of the tapered portion of the sidewall;

wherein the slots permit the tapered portion to flex to form a friction fit against an inner surface of the drainpipe to prevent debris from flowing past the basket when the strainer basket is inserted into the drainpipe;

the strainer basket affixed to the top end of the stem such that vertical movement of the stem causes corresponding movement of the strainer basket; and wherein the slots define a plurality of circumferentially spaced finger-like elements, each finger-like element being bent outwardly and then inwardly such that a transition region between the outward and inward bends forms a circumferential ridge extending about the sidewall.

2. The popup drain stopper of claim 1, wherein:

a lower length of the stem is bifurcated into a pair of coextending tangs that are separated by a lever rod receiving slot that extends from the bottom end of the stem in a direction toward the upper end of the stem;

the lever rod receiving slot being configured to removably receive a lever rod in a sliding engagement between the tangs in a direction upwardly from the bottom end of the stem; and a lower end of each tang has a winglet that extends in opposite directions of one another and provide a fish-tail-shaped notch therebetween at the bottom end of the stem, the fish-shaped notch narrows in a direction from the bottom end of the stopper toward the top end of the stopper, the winglets combined with the fishtail-shaped notch guide the lever rod toward the open end of the lever rod receiving slot when the lever rod is slid into engagement with the lever rod receiving slot.

3. The popup drain stopper of claim 1, wherein:

a lower end of the stem having a plurality of stem magnets spaced along a length of the lower end; and a retaining magnet attached to the drainpipe and configured to selectivity retain the stem at a desired position in the drainpipe by a magnetic force between a stem magnet and the retaining magnet.

4. The popup drain stopper of claim 1, wherein:

the stem further has a post that extends upwardly from top end of the stem and terminates at a free end;

the strainer basket further has a centrally located sleeve disposed within an interior of the strainer basket and extends between the closed bottom end and open top end of the strainer basket and has a length therebetween, the sleeve has a bore that extends through the entire length of the sleeve and is configured to removably receive the post such that the post extends completely through the sleeve; and a threaded stud is disposed at the free end of the post and a bottom end of the cap has a threaded aperture to which the threaded stud is threadedly received to removably attach the cap to the post and retain the strainer basket on the post and affix the strainer basket to the top end of the stem.

5. The popup drain stopper of claim 4, wherein:

a lower length of the stem is bifurcated into a pair of coextending tangs that are separated by a lever rod receiving slot that extends from the bottom end of the stem in a direction toward the upper end of the stem;

the lever rod receiving slot being configured to removably receive a lever rod in a sliding engagement between the tangs in a direction upwardly from the bottom end of the stem; and a lower end of each tang has a winglet that extends in opposite directions of one another and provide a fish-tail-shaped notch therebetween at the bottom end of the stem, the fish-shaped notch narrows in a direction from the bottom end of the stopper toward the top end of the stopper, the winglets combined with the fishtail-shaped notch guide the lever rod toward the open end of the lever rod receiving slot when the lever rod is slid into engagement with the lever rod receiving slot.

6. The popup drain stopper of claim 4, wherein:

a lower end of the stem having a plurality of stem magnets spaced along a length of the lower end; and a retaining magnet attached to the drainpipe and configured to selectivity retain the stem at a desired position in the drainpipe by a magnetic force between a stem magnet and the retaining magnet.

7. The popup drain stopper of claim 1, further comprising:

a cap disposed approximate the open top end of the strainer basket.

8. The popup drain stopper of claim 7, wherein:

the strainer basket having a post affixed thereto for conjoint movement therewith, the post being centrally disposed within the interior of the strainer basket and extending upwardly from the closed bottom end of the strainer basket to a free end proximate the top end of the strainer basket;

a first threaded stud is disposed at the free end of the post and a bottom end of the cap has first threaded aperture to which the first threaded stud is threadedly received to removably attach the cap to the post; and a second threaded stud is disposed at the top of the stem and the closed bottom end of the strainer basket has a second threaded aperture to which the second threaded stud is threadedly received to removably attach the strainer basket to the stem.

9. The pop-up drain stopper of claim 1, wherein the plurality of first apertures are elongated, forming second slots through the sidewall, and are concavely curved relative to the open top end.

10. A popup drain stopper comprising:

a stem configured to move vertically within a drainpipe between an open position and a sealing position in which the drainpipe is sealed, the stem having a top end, a bottom end, a length extending therebetween;

a cylindrically shaped strainer basket having a closed bottom end, an open top end, and a sidewall extending between the closed bottom end and the open top end, a plurality of first apertures formed therethrough about a circumference of the sidewall and between the closed bottom end and the open top end, and a plurality of second apertures formed therethrough through the closed bottom end;

wherein the sidewall has a tapered portion that tapers from narrow to wide in a direction toward the open top end such that a first diameter of the sidewall at the open top end is greater than a second diameter of the sidewall at the closed bottom end;

wherein the strainer basket has an edge that circumscribes the open top end, and a plurality of slots spaced circumferentially around the sidewall, the slots extending through the edge and along a length of the tapered portion of the sidewall;

wherein the slots permit the tapered portion to flex to form a friction fit against an inner surface of the drainpipe to prevent debris from flowing past the basket when the strainer basket is inserted into the drainpipe; and wherein the slots define a plurality of circumferentially spaced finger-like elements, each finger-like element being bent outwardly and then inwardly such that a transition region between the outward and inward bends forms a circumferential ridge extending about the sidewall.

11. The popup drain stopper of claim 10, wherein:

a lower length of the stem is bifurcated into a pair of coextending tangs that are separated by a lever rod receiving slot that extends from the bottom end of the stem in a direction toward the upper end of the stem;

the lever rod receiving slot being configured to removably receive a lever rod in a sliding engagement between the tangs in a direction upwardly from the bottom end of the stem; and a lower end of each tang has a winglet that extends in opposite directions of one another and provide a fish-tail-shaped notch therebetween at the bottom end of the stem, the fish-shaped notch narrows in a direction from the bottom end of the stopper toward the top end of the stopper, the winglets combined with the fishtail-shaped notch guide the lever rod toward the open end of the lever rod receiving slot when the lever rod is slid into engagement with the lever rod receiving slot.

12. The popup drain stopper of claim 10, wherein:

a lower end of the stem having a plurality of stem magnets spaced along a length of the lower end; and a retaining magnet attached to the drainpipe and configured to selectivity retain the stem at a desired position in the drainpipe by a magnetic force between a stem magnet and the retaining magnet.

13. The popup drain stopper of claim 10, wherein:

the stem further has a post that extends upwardly from top end of the stem and terminates at a free end;

the strainer basket further has a centrally located sleeve disposed within an interior of the strainer basket and extends between the closed bottom end and open top end of the strainer basket and has a length therebetween, the sleeve has a bore that extends through the entire length of the sleeve and is configured to removably receive the post such that the post extends completely through the sleeve; and a threaded stud is disposed at the free end of the post and a bottom end of the cap has a threaded aperture to which the threaded stud is threadedly received to removably attach the cap to the post and retain the strainer basket on the post and affix the strainer basket to the top end of the stem.

14. The popup drain stopper of claim 13, wherein:

a lower length of the stem is bifurcated into a pair of coextending tangs that are separated by a lever rod receiving slot that extends from the bottom end of the stem in a direction toward the upper end of the stem;

the lever rod receiving slot being configured to removably receive a lever rod in a sliding engagement between the tangs in a direction upwardly from the bottom end of the stem; and a lower end of each tang has a winglet that extends in opposite directions of one another and provide a fish-tail-shaped notch therebetween at the bottom end of the stem, the fish-shaped notch narrows in a direction from the bottom end of the stopper toward the top end of the stopper, the winglets combined with the fishtail-shaped notch guide the lever rod toward the open end of the lever rod receiving slot when the lever rod is slid into engagement with the lever rod receiving slot.

15. The popup drain stopper of claim 13, wherein:

a lower end of the stem having a plurality of stem magnets spaced along a length of the lower end; and a retaining magnet attached to the drainpipe and configured to selectivity retain the stem at a desired position in the drainpipe by a magnetic force between a stem magnet and the retaining magnet.

* * * * *